US008863680B2

(12) United States Patent
Urciuoli

(10) Patent No.: US 8,863,680 B2
(45) **Date of Patent: *Oct. 21, 2014**

(54) MARINE CRAFT DEPLOYMENT AND RECOVERY

(75) Inventor: Joseph Charles Urciuoli, North Easton, MA (US)

(73) Assignee: MacTaggart, Scott (Holdings) Limited, Midlothian (GB)

( * ) Notice: Subject to any disclaimer, the term of this patent is extended or adjusted under 35 U.S.C. 154(b) by 32 days.

This patent is subject to a terminal disclaimer.

(21) Appl. No.: 13/413,344

(22) Filed: Mar. 6, 2012

(65) Prior Publication Data

US 2012/0227656 A1 Sep. 13, 2012

Related U.S. Application Data

(63) Continuation-in-part of application No. 13/041,938, filed on Mar. 7, 2011.

(51) Int. Cl.

| | |
|---|---|
| ***B63B 35/40*** | (2006.01) |
| ***B63B 23/00*** | (2006.01) |
| *B63C 3/02* | (2006.01) |
| *B63B 21/56* | (2006.01) |

(52) U.S. Cl.

CPC ..... *B63B 23/00* (2013.01); *B63B 35/40* (2013.01); *B63C 3/02* (2013.01); *B63B 21/56* (2013.01)

USPC ..... 114/259

(58) Field of Classification Search

USPC ..... 114/254, 258, 259; 405/205, 206

See application file for complete search history.

(56) References Cited

U.S. PATENT DOCUMENTS

| | | | |
|---|---|---|---|
| 3,430,305 | A | 3/1969 | Geffner |
| 3,807,335 | A | 4/1974 | Talkington |
| 3,937,163 | A | 2/1976 | Rosenberg |
| 3,943,875 | A | 3/1976 | Sanders |
| 3,955,522 | A | 5/1976 | Gaudiano |
| 5,253,605 | A | 10/1993 | Collins |
| 6,676,334 | B2 | 1/2004 | Horton |
| 7,156,036 | B2 | 1/2007 | Seiple |
| 7,699,015 | B1 | 4/2010 | Said |
| 2006/0254491 | A1 | 11/2006 | Seiple |

FOREIGN PATENT DOCUMENTS

| | | |
|---|---|---|
| WO | 0121476 | 3/2001 |

OTHER PUBLICATIONS

European Search Report received in corresponding EP Application No. EP12158411, dated Nov. 30, 2012.

European Search Report received in corresponding EP Application No. EP12158413, date Jun. 19, 2012.

Office Action issued on U.S. Appl. No. 13/042,118 dated Jan. 22, 2013.

Office Action issued on U.S. Appl. No. 13/042,118 dated Jun. 13, 2012.

Final Office Action issued on U.S. Appl. No. 13/041,938 dated Jan. 15, 2013.

Office Action issued on U.S. Appl. No. 13/041,938 dated Jun. 11, 2012.

*Primary Examiner* — Lars A Olson

(74) *Attorney, Agent, or Firm* — Wong, Cabello, Lutsch, Rutherford & Brucculeri LLP

(57) ABSTRACT

A marine craft recovery system for recovering a marine craft to a mother ship comprises a marine craft engagement apparatus and at least a pair of tensile members between the marine craft engagement apparatus and the mother ship. The marine craft engagement apparatus is configured to engage at least a portion of the marine craft, such as the hull. The pair of tensile members is configured to pull the marine craft engagement apparatus towards respective first and second anchor points on the mother ship. The system is configured to transport the marine craft engagement apparatus across a body of water towards the mother ship.

20 Claims, 17 Drawing Sheets

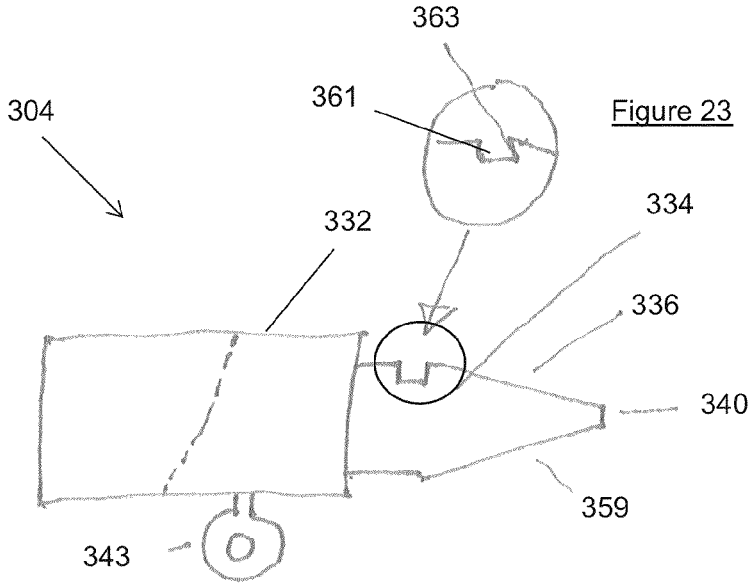
Figure 23
Figure 22
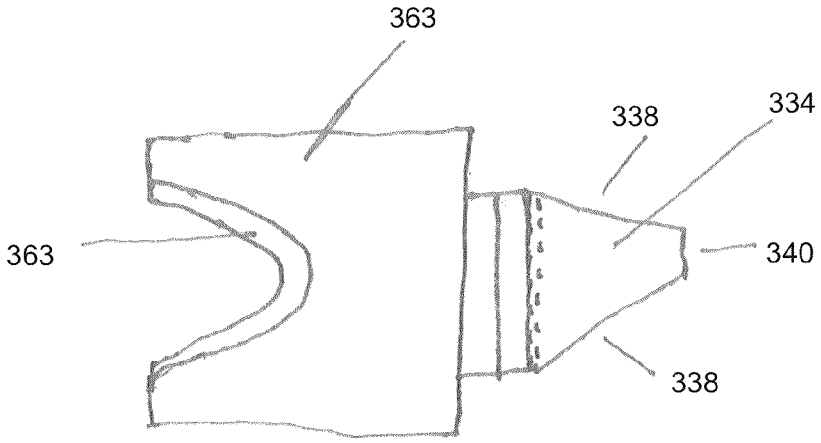
Figure 24

MARINE CRAFT DEPLOYMENT AND RECOVERY

CROSS REFERENCE TO RELATED APPLICATIONS

This present application is a continuation-in-part of pending U.S. patent application Ser. No. 13/041,938 filed on Mar. 7, 2011, the contents of which are incorporated herein by reference.

FIELD OF THE INVENTION

This invention relates to a marine craft recovery system and associated methods; in particular, but not exclusively, for the deployment and recovery of a satellite marine craft such as a Rigid Inflatable Boat (RIB) from/to a mother ship.

BACKGROUND OF THE INVENTION

Boats such as RIB's are often deployed and/or recovered from a mother vessel, such as another boat. For example, satellite boats such as lifeboats, rescue boats and landing craft are often launched from and recovered to larger mother ships, where the satellite boats are often stowed for journeys over long distances to a particular location. Satellite boats are often intended for a specific purpose, such as high speed operations, and may be less suitable for long journeys in exposed waters than the mother ship.

Satellite boats are often launched from the stern of a mother ship by lifting into the water such as with a crane; or by lowering via a ramp or a slipway. Alternatively, satellite boats are launched from the lee of a mother vessel: typically lowered over the side by a winch. Unless the mother vessel can accommodate the satellite boat within a wet dock accessible via a stern door, the satellite boat is generally recovered to the mother vessel by hauling the boat at least partially out of the water, such as with a crane. To haul the satellite boat, a line is typically thrown, from either the mother vessel or the satellite boat, which usually involves both the satellite boat and the mother vessel reducing speed.

The launch and/or recovery of the satellite boat may require the mother vessel to alter its course, typically slowing down and often coming to a standstill to control a relative position between the satellite boat and the mother vessel. However, altering the course of the mother ship may be detrimental to other operations, such as increasing journey time of the mother ship to a destination. Slowing the mother ship and/or the satellite boat may affect their movement in the water, such as the roll, pitch and yaw; which may hamper the recovery or launch. Furthermore, waiting to slow the mother vessel down may be detrimental to the operation of the satellite boat: for example, delaying the launch of a lifeboat to perform a rescue.

SUMMARY OF THE INVENTION

According to a first aspect of the present invention, there is provided a marine craft recovery system for recovering a marine craft to a mother ship, the system comprising:

a marine craft engagement apparatus for coupling to at least a portion of the marine craft;

at least a first tensile member and a second tensile member, the first and second tensile members configured to extend between the marine craft engagement apparatus and the mother ship;

a first pulling mechanism configured to pull the first tensile member towards a first anchor point on the mother ship; and a second pulling mechanism configured to pull the second tensile member towards a second anchor point on the mother ship;

wherein the system is configured to transport the marine craft engagement apparatus across a body of water towards the mother ship.

A system that is configured to transport a marine craft engagement apparatus across a body of water towards a mother ship may permit a marine craft to be recovered from a position remote from the mother ship. Providing at least first and second tensile members configured to pull the marine craft engagement apparatus towards respective first and second anchor points on the mother ship may permit an improved control of a position of the marine craft engagement apparatus relative to the mother ship.

The first tensile member may be configured to pull the marine craft engagement apparatus in a first direction towards the first anchor point and the second tensile member may be configured to pull the marine craft engager in a second direction towards the second anchor point, wherein the first and second directions are different.

The first and second tensile members may be configured to pull the marine craft engagement apparatus in divergent directions.

The first and second tensile members may be configured to pull the marine craft engagement apparatus in divergent directions towards the mother ship.

The first and second tensile members may be configured to pull the marine craft engagement apparatus in divergent directions simultaneously.

The system may be configured to pull the marine craft engagement apparatus in a third direction. For example, the marine craft engagement apparatus may be configured to drag in the water, such as when towed by the mother ship. The system may comprise a propulsion unit configured to pull the marine craft engagement apparatus in the third direction. For example, a motor may be connected to the marine craft engagement apparatus. The marine craft engagement apparatus may comprise the propulsion unit. The marine craft may comprise the propulsion unit. Providing the propulsion unit in the marine craft may permit an arrangement of the marine craft connected to the marine craft engagement apparatus to accommodate external forces, such as to steer into a side current.

Pulling the marine craft engagement apparatus in a third direction may permit the marine craft engagement apparatus to have a stable position. For example where the resultant force of the first and second tensile members and the propulsion unit provides for a neutral position, the forces of the tensile members and/or the propulsion unit may prevent or limit external forces, such as waves, wind or tide, from substantially altering the position of the marine craft engagement apparatus, which may be attached to the marine craft. The position of the marine craft engagement apparatus may be stable with respect to the mother ship.

The system may be configured to locate the neutral position of the marine craft engagement apparatus relative to the mother ship. For example, the lengths of the tensile members between the anchor points and the marine craft engagement apparatus may be such that the neutral position is located in a preferred portion of a wake of the mother ship, such as a relatively calm sweet spot. The neutral position may be located substantially outside the wake of the mother ship. Defining the position of the marine craft engagement apparatus relative to the wake of the mother ship may permit the marine craft engagement apparatus to receive the marine craft in relatively less turbulent waters.

Pulling the marine craft engagement apparatus in a third direction may permit the marine craft engagement apparatus to be controllably moved. For example, the resultant force of the first and second tensile members and the propulsion unit may provide for a net resultant transporting force, such as towards the mother ship. The forces of the tensile members and/or the propulsion unit may prevent or limit external forces, such as waves, wind or tide, from substantially influencing the movement of the marine craft engagement apparatus, such as towards the mother ship.

The third direction may be substantially away from the mother ship. For example, the propulsion unit may act as a brake, such as a marine craft's motor providing a reverse thrust.

The first, second and third directions may diverge away from the marine craft engagement apparatus.

The first and/or second and/or third directions may be in substantially the same plane, such as substantially the same horizontal plane.

The first pulling mechanism may comprise a first winch.

The first pulling mechanism may comprise the second pulling mechanism. For example, the first winch may be configured to pull the first tensile member and the first winch may be configured to pull the second tensile member.

The second pulling mechanism may comprise a second winch. The first pulling mechanism may be operatively linked to the second pulling mechanism. For example, the system may be configured to activate the first and second pulling mechanisms simultaneously.

The first pulling mechanism may be operable independently of the second pulling mechanism. For example, the system may be configured to activate the first and second pulling mechanisms with different speeds and/or different tensile forces.

The system may be configured to apply the same tensile force to the first tensile member and to the second tensile member. For example, the system may comprise at least one tensile force sensor. The system may be configured to monitor a tensile force in the first and/or second tensile member. The system may be configured to control tensile force in the first and/or second tensile member. For example, the system may comprise a control unit, the control unit configured to adjust tension in the first tensile member in response to a measured tensile force by adjusting the first pulling mechanism.

The first and/or second pulling mechanism may be positioned on the mother ship, such as towards a stern of the mother ship.

The first and second anchor points may be in substantially the same horizontal plane. Providing the first and second anchor points in substantially the same horizontal plane may permit the system to maintain the vertical orientation of the marine craft engagement apparatus.

The first anchor point may be movable relative to the mother ship.

The first anchor point may be fixed relative to the mother ship.

The second anchor point may be movable relative to the mother ship.

The second anchor point may be fixed relative to the mother ship.

The first anchor point may be defined by a first pulley. The first pulley may comprise a first sheave.

The second anchor point may be defined by a second pulley. The second pulley may comprise a second sheave.

A rotation axis of the first and/or second pulley may be configured to pivot. For example, the first and/or second sheave may be configured to flag.

The rotation axis of the first and/or second pulley may be fixed.

The first anchor point may be mounted to a first anchor transport system. For example, the first anchor point may be mounted on a guide system, such as a rail. The first anchor point may be dynamically positioned along the guide system. The anchor transport system may be powered. For example, the anchor transport system may be electrically and/or hydraulically and/or manually powered.

The second anchor point may be mounted to a second anchor transport system.

The first anchor transport system may be operatively linked to the second anchor transport system.

The first anchor transport system may be operatively independent from the second anchor transport system.

The first and/or second anchor transport system/s may be configured to move the respective first and/or second anchor points fore and/or aft relative to the mother ship.

The first and/or second anchor transport system/s may be configured to move the respective first and/or second anchor points laterally relative to the mother ship.

The first and/or second anchor transport system/s may be configured to move the respective first and/or second anchor points up and/or down relative to the mother ship.

The first and/or second anchor transport system/s may be configured to move the first and/or second anchor points respectively during different stages of a marine craft recovery and/or deployment. For example, the first anchor transport system may be configured to position the first anchor point in an aft position when the marine craft engagement apparatus is in a remote position from the mother ship; and to move the first anchor point to a fore position when pulling the marine craft engagement apparatus proximal to the mother ship, such as up a ramp on the mother ship.

The first and/or second anchor transport system/s may comprise a belt, such as a chain belt.

The first and/or second anchor transport system/s may be electrically driven.

The first and/or second anchor transport system/s may be hydraulically driven.

Positioning the first and/or second anchor transport system/s in an aft position may permit improved control of the marine craft engagement apparatus.

Positioning the first and/or second anchor transport system/s in a fore position may permit at least partial pulling of the marine craft into the mother ship.

The first and/or second anchor transport system/s may be configured to vary an angle between the respective first and/or second tensile members.

The marine craft recovery system may be configured to pull the marine craft engagement apparatus towards the mother ship with at least the first pulling mechanism.

The marine craft recovery system may be configured to pull the marine craft engagement apparatus at least partially into the mother ship with at least the first anchor transport system.

The first and/or second anchor transport system may be configured to maintain lateral forces on the marine craft engagement apparatus; such as maintaining lateral forces on the marine craft engagement apparatus during at least partially pulling the marine craft inside the mother ship.

The marine craft engagement apparatus may comprise at least one negatively buoyant portion.

The marine craft engagement apparatus may comprise at least one positively buoyant portion.

The negatively and/or positively buoyant portion may permit a definition of a vertical orientation of the marine craft engagement apparatus in the water.

The system may be configured to vary the relative height of the marine craft engagement apparatus in the water. For example, the marine craft engagement apparatus may be configured to rise or lower in the water as the relative horizontal speed between the hull-engaging portion and the water increases. Varying the height of the marine craft engagement apparatus relative to the water dependent upon the relative speed between the marine craft engagement apparatus and the water may permit the marine craft engagement apparatus to adapt to a varying height of a marine craft height relative to the water: for example, where a marine craft planes out of the water at higher speeds. The marine craft engagement apparatus may comprise a pressure differential profile, such as a fin and/or a foil.

The system may be configured to maintain the height of the marine craft engagement apparatus in the water. For example, the marine craft engagement apparatus may be configured to maintain the same height of the marine craft engagement apparatus in the water at various speeds.

The marine craft engagement apparatus may comprise an opening. The opening may correspond to the portion of the hull of the marine craft. The hull-engaging opening may be configured to receive at least a portion of a bow of a marine craft and/or at least a portion of a stern of a marine craft. The opening may be a divergent opening. The opening may comprise an angle greater than an angle formed by the hull portion of the marine craft. For example, the marine craft engagement apparatus may comprise left and right side portions, the left and right side portions converging towards a front of the marine craft engagement apparatus, defining the opening. The divergent opening may be adjustable. For example, the left and right side portions may be adjustable to accommodate different hull forms of different marine crafts. The side portions may be configured to abut the hull portion when the marine craft is connected to the marine craft engagement apparatus.

The marine craft engagement apparatus may be configured to secure the marine craft. For example, the marine craft engagement apparatus may comprise a connector, the connector fixing the marine craft to the marine craft engagement apparatus.

The system may be configured to recover the marine craft whilst the mother ship and/or marine craft is travelling at high speed; such as without substantially altering speed.

The system may be configured to deploy the marine craft from the mother ship. For example, the first and/or second pulling mechanism may pay out the first and/or second tensile member.

The connector may be configured to release the marine craft, such as when the marine craft reaches a neutral position. For example the system may comprise an actuator for releasing the marine craft from the marine craft engagement apparatus by disconnecting the connector. The actuator may be configured to be controlled from the mother ship or other remote location, for example, where the marine craft is unmanned. The actuator may be configured to be controlled from the marine craft, for example by the helmsman.

The marine craft engagement apparatus may be configured to engage the same portion of the marine craft hull during deployment and recovery.

The marine craft engagement apparatus may be configured to engage different portions of the marine craft hull during deployment and recovery. For example, the marine craft engagement apparatus may be configured to engage the marine craft bow during recovery and the marine craft stern during deployment.

The system may comprise a plurality of marine craft engagement apparatus. For example, the system may comprise a first marine craft engagement apparatus for recovery of the marine craft and a second marine craft engagement apparatus for deployment of the marine craft.

According to a second aspect of the invention there is provided a method of recovering a marine craft to a mother ship, the method comprising:

deploying a marine craft engagement apparatus from the mother ship;

controlling a position of the marine craft engagement apparatus in a body of water astern the mother ship with at least a first and a second tension members;

manoeuvring the marine craft into the marine craft engagement apparatus such that at least a portion of the marine craft hull engages the marine craft engagement apparatus;

connecting the marine craft to the marine craft engagement apparatus;

controlling a movement of the marine craft engagement apparatus across a body of water towards the mother ship with the at least a first and second tensile members.

The method may further comprise controlling a movement of the marine craft engagement apparatus by varying the position of at least one movable anchor point on the mother ship, the anchor point connected to at least one of the tension members.

The method may further comprise shortening at least one tension member. For example, at least one tension member may be attached to a winch, the winch pulling in a controlled length of the tension member.

According to a third aspect of the present invention, there is provided a marine craft deployment system for deploying a marine craft from a mother ship, the system comprising:

a marine craft engagement apparatus configured to receive at least a portion of a hull of a marine craft; and at least a first and a second tensile members between the marine craft engagement apparatus and a mother ship, the first and second tensile members configured to pull the marine craft engagement apparatus towards respective first and second anchor points on the mother ship;

wherein the system is configured to transport the marine craft engagement apparatus across a body of water away from the mother ship.

According to a fourth aspect of the invention, there is provided a method of deploying a marine craft from a vessel, the method comprising:

releasing a marine craft engagement apparatus from a mother ship, the marine craft engagement apparatus connected to a marine craft;

controlling a movement of the marine craft engagement apparatus across a body of water away from the mother ship with at least a first and a second tension members;

releasing the marine craft from the marine craft engagement apparatus.

The method may further comprise controlling a movement of the marine craft engagement apparatus by varying the position of at least one movable anchor point on the mother ship connected to at least one of the tension members.

The method may further comprise lengthening at least one tension member. For example, at least one tension member may be attached to a winch, the winch paying out a controlled length of the tension member.

According to a fifth aspect of the present invention, there is provided a marine craft engagement apparatus for use in the recovery of a marine craft to a mother ship, the apparatus comprising:

a receptacle adapted to be coupled to one of a mother ship and a marine craft;

an engagement probe adapted to be coupled to the other of the mother ship and the marine craft, wherein the engagement probe is adapted to engage one or more engagement locations in the receptacle to align the probe with the receptacle; and a locking device configured to secure the probe to the receptacle to secure the marine craft to the mother ship for recovery.

In use, embodiments of the present invention facilitate accurate and secure engagement between a marine craft to be recovered and the mother ship with little or no human intervention or skill. Accordingly, recovery and/or deployment of the marine craft may be achieved quickly and reliably in environments where there would otherwise be high risk of injury to crew or passengers on either vessel, such as high sea states or in subsurface environments; where either or both vessels are to be manoeuvred by relatively unskilled persons; or in cases where the craft to be recovered is remotely operated or unmanned.

The marine craft engagement apparatus may be for use in the deployment of the marine craft from the mother ship.

The receptacle may be coupled to, or provided on, the mother ship and the engagement probe may be coupled to, or provided on, the marine craft to be recovered. Alternatively, the receptacle may be coupled to, or provided on, the marine craft to be recovered and the engagement probe may be coupled to, or provided on, the mother ship, as required.

The receptacle may comprise a plurality of engagement locations for receiving the engagement probe. The engagement locations may be of any suitable form and may, for example, comprise a plurality of spaced holes, slots or channels located in a wall of the receptacle. In particular embodiments, the engagement locations comprise a plurality of vertically spaced channels.

The provision of a plurality of engagement locations facilitates engagement between the probe and the receptacle even where there is significant relative motion, between the receptacle and the probe, for example significant vertical motion as may be the case in high sea states. The provision of slots or channels facilitates location of the probe in the receptacle in conditions where there is significant relative sideways motion between the mother ship and the marine craft to be recovered.

The receptacle may be formed or otherwise configured to receive the probe. For example, the receptacle may comprise at least one ramp for directing the probe into the, or each, engagement location on initial engagement. The ramp may extend from the receptacle. Alternatively, or in addition, at least one engagement location may comprise a tapered entrance. Beneficially, the provision of a ramp or tapered entrance assists in directing the probe into an engagement location or plurality of engagement locations, thereby obviating or mitigating the possibility that the probe will become lodged between engagement locations or only partially engage a given engagement location or locations.

The receptacle may further comprise at least one recess configured to receive a leading end of the probe. For example, the receptacle may comprise one or more recess corresponding to each engagement location.

The engagement probe may be of any suitable form. For example, the probe may comprise a first portion arranged to initially engage the receptacle. In use, the probe first portion may be arranged to initially engage the receptacle to assist in accurately aligning the probe with the receptacle with little or no human intervention.

The probe first portion may comprise a dagger or other male projection.

The probe first portion may be formed or otherwise configured to mate with the engagement location. For example, the first portion may be shaped to conform to the engaged hole, slot, channel or other engagement location. In some embodiments, a leading end of the probe first portion may be shaped to conform to the recess provided in the receptacle. Alternatively, or in addition, a base of the probe first portion may be shaped to conform to the mouth of the engagement location. Further alternatively or additionally, an intermediate portion of the probe first portion may be shaped to conform to a wall of the engagement location.

The probe may comprise one first portion. Alternatively, the probe may comprise a plurality of first portions.

The probe first portion may also be configured to provide gripping engagement between the probe and the receptacle.

The probe may further comprise a second portion configured to engage an outer wall of the receptacle. The probe second portion may comprise any suitable arrangement. In particular embodiments, the probe second portion may comprise wings extending towards and configured to engage the outside of the receptacle. In use, the second probe portion, for example the wings, may engage the outside of the receptacle after initial engagement by the probe first portion to assist in alignment of the probe with the receptacle. The probe second portion may also be configured to provide gripping engagement between the probe and the receptacle.

The engagement probe may be provided in addition to, or may be integrated with, the marine craft's v-guide or other attachment device. The locking device may be provided on the probe and configured to engage the receptacle following alignment of the probe with the receptacle.

The locking device may be configured to engage an engagement location. For example, the locking device may be configured to engage the same engagement location as the probe first portion. The engagement locations may be formed to permit both the probe and the first and second probe portions to be received. In particular embodiments, however, the locking device may be configured to engage an adjacent or other different engagement location to that of the probe first portion.

Thus, engagement between the probe first portion with a given engagement location may ensure accurate alignment so that when the locking device is activated, secure engagement between the probe and receptacle may be ensured.

The locking device may be of any suitable form. For example, the locking device may comprise at least one of a latch, hook arm or other suitable securement device. In particular embodiments, two hook arms are provided, each arm configured to engage a corresponding shoulder in the receptacle. Each hook arm and shoulder may define right angle contact surfaces. Alternatively, each hook arm and shoulder may define corresponding acute angles, whereby the hook arm and shoulder provide a wedge lock.

It will be recognised that once the locking device engages the receptacle, such as where the hook arms engage the shoulders, forces acting to separate the probe and the receptacle will act to further secure the probe to the receptacle and prevent or at least mitigate unintended disengagement. These separating forces may be the result of, for example, astern (reverse) thrust by the marine craft or pull forces exerted on the receptacle by the mother ship.

Accordingly, in use the marine craft to be recovered may be directed into engagement with the receptacle; the probe first portion first engaging and aligning the marine craft with the receptacle and the locking device then being activated to secure the craft to the receptacle and thus the mother ship, facilitating transport of the marine craft towards the mother ship.

The engagement apparatus may further comprise an activation arrangement configured to activate the locking device. The activation arrangement may be of any suitable form. The activation arrangement may, for example, comprise at least one of: a mechanical activation arrangement; a hydraulic activation arrangement; a pneumatic activation arrangement; and an electric activation arrangement. In particular embodiments, the activation arrangement may comprise a spring coupled to the probe first portion. In use, on full engagement between the probe first portion and the engagement location, for example when the leading end of the probe first portion engages a recess, the probe first portion may be displaced axially against the spring, this axial movement activating, or generating a signal to cause activation of, the locking device.

The apparatus may further comprise an indicator arrangement configured to indicate the condition of the apparatus to a user, for example to the helmsman on the marine craft, to a crew member on the mother ship or to another remote location. In use, the indicator arrangement may, for example, be configured to indicate at least one of: alignment between the probe and the receptacle; engagement between the probe and the receptacle; full engagement between the probe first portion and an engagement location so that activation of the locking device may be initiated; and disengagement between the probe and the receptacle.

The indicator arrangement may comprise any suitable means. The indicator arrangement may be configured to indicate the condition of the apparatus by emission of a signal. In some embodiments, the indicator arrangement may comprise a device configured to emit a light signal, for example but not exclusively an LED, a lamp or other suitable device, or a radio frequency signal.

The indicator arrangement may comprise a visual indicator arrangement. Alternatively, or in addition, the indicator arrangement may comprise a tactile indicator arrangement. Alternatively, or in addition, the indicator arrangement may comprise an audible indicator arrangement.

The indicator arrangement may be provided on one or more of the marine craft to be recovered, the mother ship or other remote location.

The apparatus may further comprise a control system configured to initiate engagement and disengagement between the probe and the receptacle. In some embodiments, the control system may be configured to automatically initiate activation or deactivation of the locking device. In other embodiments, the control system may used in combination with the indicator arrangement and a user, whereby on receiving an appropriate signal from the indicator arrangement, the user is directed to operate the control system to activate or deactivate the locking device.

According to a further aspect of the present invention, there is provided a receptacle for an engagement apparatus according to the first aspect of the present invention.

According to a further aspect of the present invention, there is provided an engagement probe for an engagement apparatus according to the first aspect of the present invention.

According to a further aspect of the present invention, there is provided a method for engaging a marine craft to a mother ship for recovery, the method comprising:

providing a receptacle on one of a mother ship and a marine craft; and providing an engagement probe on the other of the mother ship and the marine craft;

engaging the engagement probe with one or more engagement locations in the receptacle to align the probe with the receptacle; and securing the probe to the receptacle to secure the marine craft to the mother ship.

Securing the probe to the receptacle may comprise activating a locking device provided on the probe. In particular embodiments, the locking device may be activated by full engagement between a probe first portion and the engagement location.

According to another aspect of the present invention there is provided a marine craft engagement apparatus comprising:

a first coupling adapted to be coupled to one of a mother ship and a marine craft to be recovered;

a second coupling configured to engage the first coupling, wherein the first and second couplings are arranged to latch on contact to secure the marine craft to the mother ship.

The coupling configured to engage the mother ship may be buoyant. The couplings may be of any suitable form and may, for example comprise at least one of a mechanical coupling, magnetic coupling, hydraulic coupling, and a pneumatic coupling.

The invention includes one or more corresponding aspects, embodiments or features in isolation or in various combinations whether or not specifically stated (including claimed) in that combination or in isolation. For example, it will readily be appreciated that features recited as optional with respect to one aspect may be additionally applicable with respect to another aspect, without the need to explicitly and unnecessarily list those various combinations and permutations here. Accordingly, it should be understood that any of the features defined above in accordance with any aspect of the present invention or described below in relation to an embodiment may be utilised, either alone or in combination with any other defined feature, in any other aspect of the invention.

It will be appreciated that one or more embodiments/aspects may be useful in recovering or deploying a marine craft to or from a mother ship.

BRIEF DESCRIPTION OF THE DRAWINGS

These and other aspects of the present invention will now be described, by way of example only, with reference to the accompanying drawings, in which:

FIG. 22 shows a side view of a probe according to another embodiment of the present invention;

FIG. 23 shows an enlarged view of part of the probe shown in FIG. 22.

FIG. 24 shows a top view of the probe shown in FIG. 22;

DETAILED DESCRIPTION OF THE DRAWINGS

Figure 1:
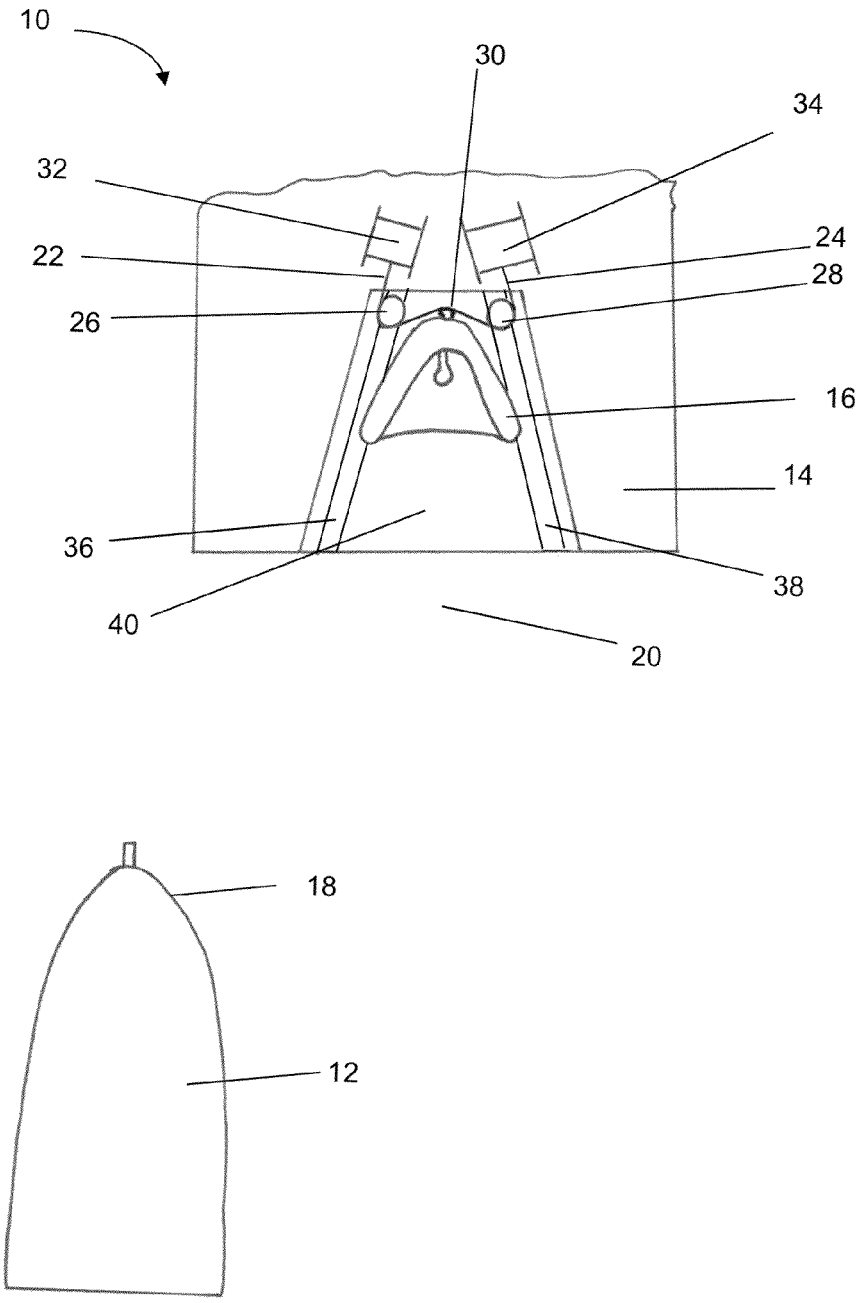
FIG. 1 is a schematic plan view of a marine craft recovery system according to an embodiment of the present invention.

Reference is first made to FIG. 1 in which there is shown a marine craft recovery system 10 in accordance with an embodiment of the present invention for use in recovering a marine craft 12 to a mother ship 14. The system 10 comprises a hull engager 16 configured to receive a bow portion 18 of the marine craft 12. In use, the hull engager 16 is deployed behind the mother ship 14 to provide a docking facility for the marine craft 12 remote from the mother ship 14, and to transport the marine craft 12 in the hull engager 16 across a body of water 20 towards the mother ship 14.

The system 10 has a pair of cables 22, 24 extending between the hull engager 16 and the mother ship 12. The cables 22, 24 are wound around respective pulleys 26, 28 and connected to the hull engager 16 at its bow 30. In use, the pulleys 26, 28 act as anchor points for the hull engager 16, determining the points on the mother ship 14 to which the hull engager 16 is pulled. The cables 22, 24 are connected to respective winches 32, 34 which control the payout of the cables 22, 24. As will be described in further detail below, the pulleys 26, 28 are mounted on guide rails 36, 38 that position the pulleys 26, 28 on the mother ship 14.

In FIG. 1, the hull engager 16 is shown in a fully recovered position, with the pulleys 26, 28 and the hull engager 16 in foremost positions within a stern well 40 for receiving the marine craft 12. In FIG. 1, the marine craft 12 is shown in proximity to the mother ship 14 and only a portion of the mother ship 14 is shown, for clarity.

Figure 2:
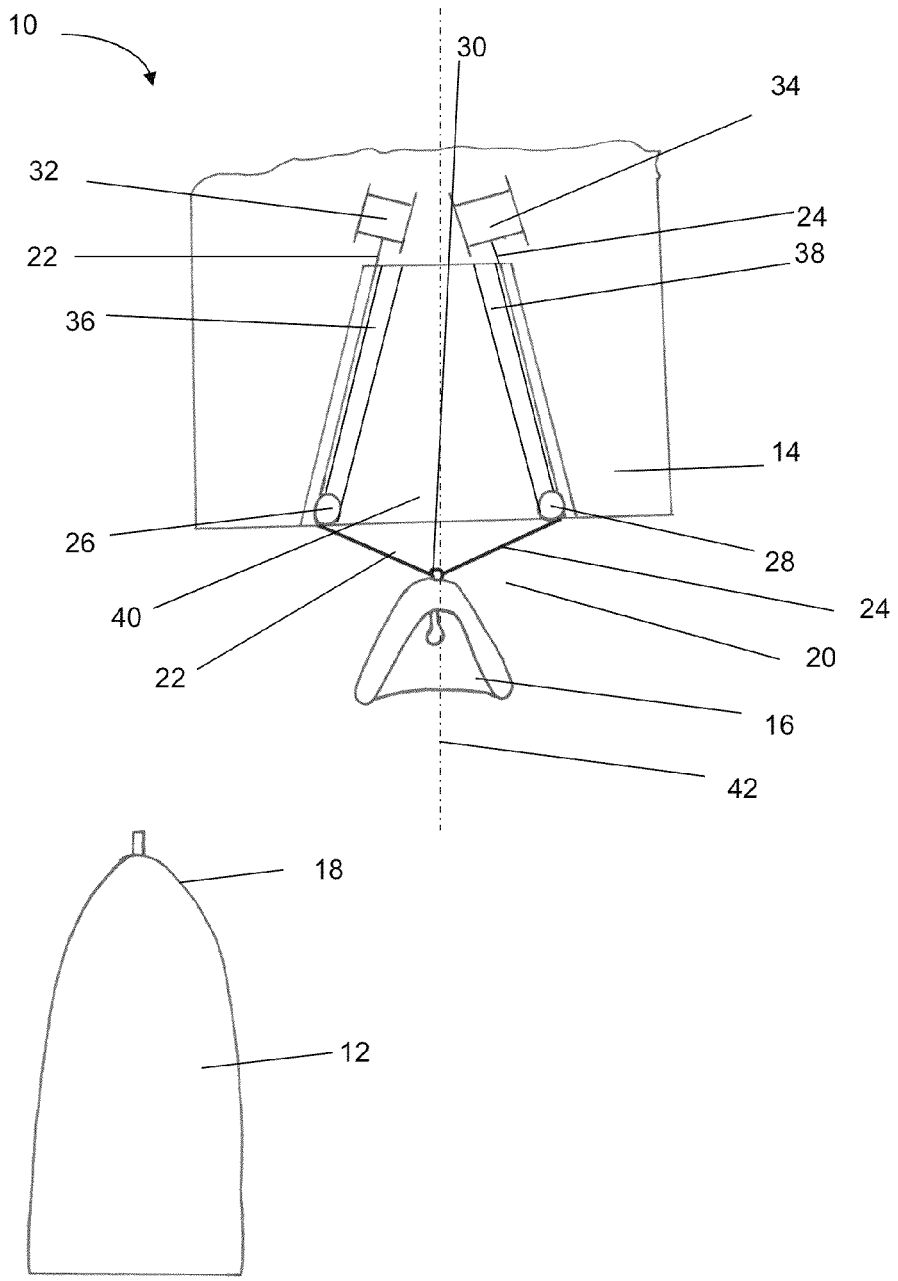
FIG. 2 is a schematic plan view of the marine craft recovery system shown in FIG. 1, with a hull dock partially deployed.

In FIG. 2, the hull engager 16 is shown in a partially deployed position, with the pulleys 26, 28 deployed to rearmost positions on the guide rails 36, 38. The cables 22, 24 have been partially paid out by the respective winches 32, 34 such that the hull engager 16 is deployed in the body of water 20 proximal to the stern of the mother ship 14. The transition of the hull engager 16 from the position of FIG. 1 to the position of FIG. 2 is assisted by driving the pulleys 26, 28 rearwards along the guide rails 36, 38. The pulleys 26, 28 are driven by a carbon transmission belt (not shown); although in other embodiments, the pulleys 26, 28 may be driven by a chain belt or other suitable arrangement. The payout of the cables 22, 24 from the respective winches 32, 34 is controlled to maintain a tension in the cables 22, 24 between the pulleys 26, 28 and the hull engager 16. The hull engager 16 comprises rollers on its underside that cooperate with a central guide in the stern well 40 to assist in a smooth transition of the hull engager 16 from the position of FIG. 1 to the position of FIG. 2.

Figure 3:
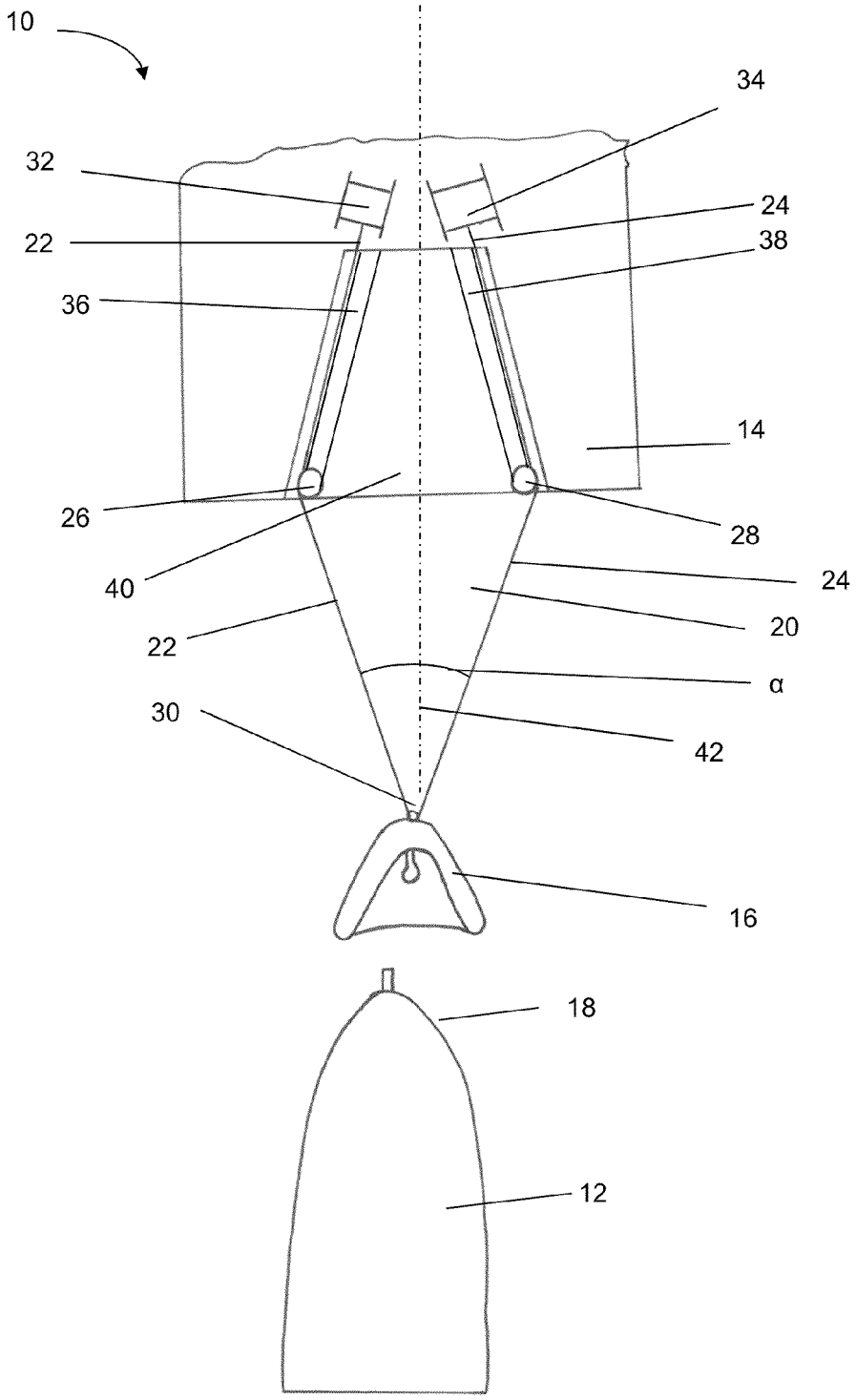
FIG. 3 is a schematic plan view of the marine craft recovery system shown in FIG. 1, with the hull dock fully deployed in the vicinity of a marine craft.

Once in the body of water 20 in the position of FIG. 2, the forward movement of the mother ship 14 and the drag of the hull engager 16 in the body of water 20 pulls the hull engager 16 to the fully deployed position of FIG. 3. The winches 32, 34 control the relative movement of the hull engager 16 during deployment and maintain the position of the hull engager 16 when deployed. Although not to scale, the schematic view of FIG. 3 clearly shows the divergent angle $\alpha$ between the cables 22, 24 that assists in maintaining the position of the hull engager 16 relative to an extended central axis 42. The angle $\alpha$ is smallest when the hull engager 16 is in a distalmost position from the mother ship, typically 5 to 10 degrees. When pulling the hull engager 16 towards the mother ship 14, the angle $\alpha$ is greatest when the hull engager 16 is in a most proximal position to the mother ship 14: typically 135 degrees. Together with the drag on the hull engager 16, the pull of the cables 22, 24 in divergent directions ensures that the hull engager 16 is subjected to three vectors, helping maintain the position of the hull engager 16, even when subjected to external forces, such as waves, winds or currents.

A helmsman on the marine craft 12 (or, if the marine craft 12 is unmanned, a remote operator) can steer the marine craft 12 towards the hull engager 16, as shown in FIG. 3. The body of water 20 between the hull engager 16 and the mother ship 14 reduces the risk of collision between the marine craft 12 and the mother ship 14 and provides the helmsman or remote operator with a predictable water flow fore of the marine craft 12. The helmsman or remote operator manoeuvres the marine craft 12 bow portion 18 into the hull engager 16, whereby a connector or engagement apparatus automatically couples the marine craft 12 to the hull engager 16. The hull engager 16 is rigid, made of CRES, with hard rubber backed internal sides to receive the bow portion 18. The hull engager 16 has a bottom portion with an inclined internal face sloping rearwards, such that the bow portion 18 is raised as it is manoeuvred into the hull engager 16.

Figure 4:
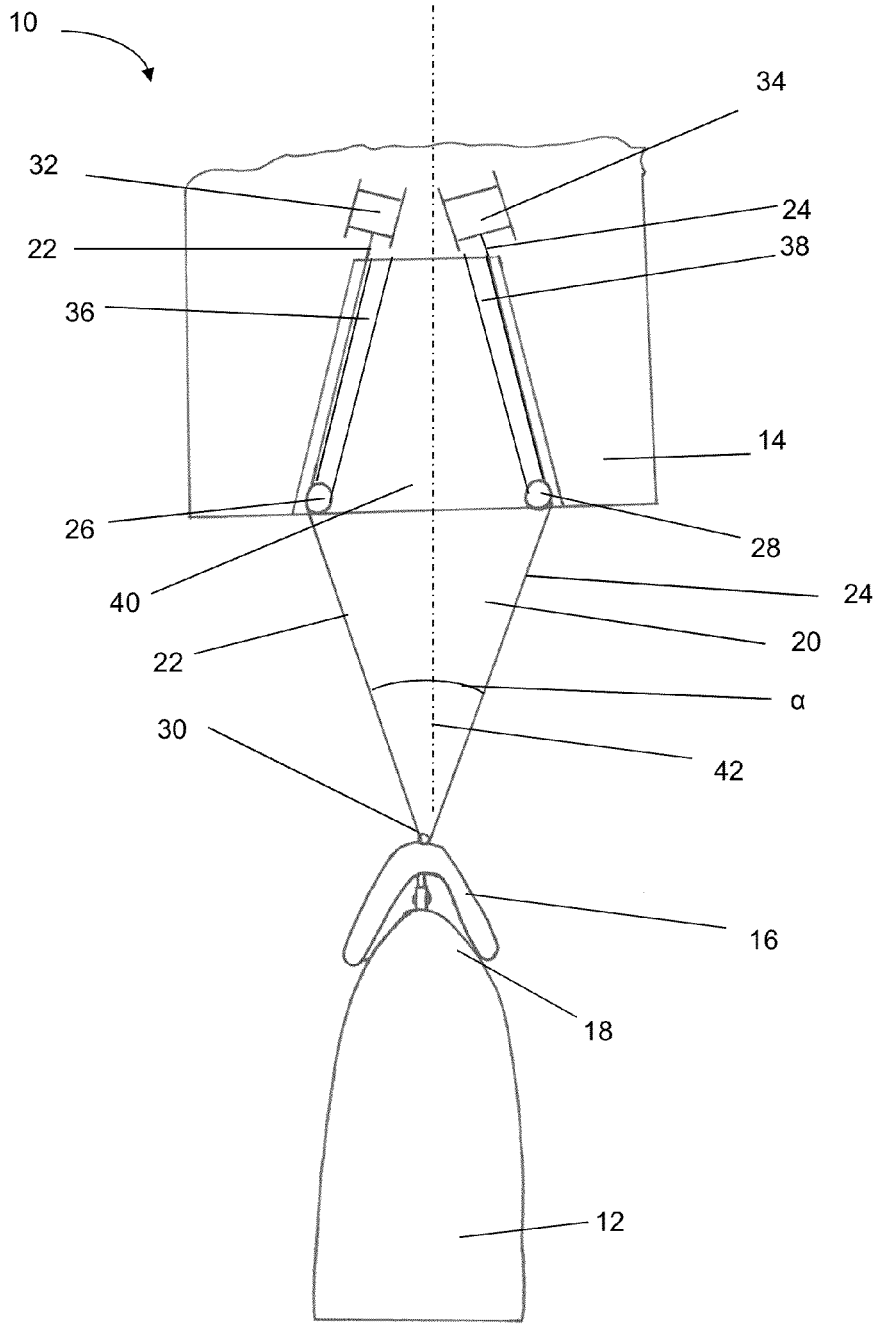
FIG. 4 is a schematic plan view of the marine craft recovery system shown in FIG. 1, with the marine craft received in the hull dock in the fully deployed position.

Once the marine craft 12 is coupled to the hull engager 16 as in the arrangement shown in FIG. 4, the helmsman or remote operator applies reverse propulsion thrust. The reverse thrust takes up any slack in the cables 22, 24; and prevents the marine craft 12 surging, such as in turbulent currents. Should the marine craft 12 be exposed to side currents, the helmsman or remote operator can steer the marine craft 12 accordingly, such as adjusting a rudder or the direction of reverse propulsion. With the marine craft 12 maintaining tension in the cables 22, 24, the winches 32, 34 progressively pull in the cables 22, 24, propelling the arrangement of the hull engager 16 and the marine craft 12 across the body of water 20 towards the stern of the mother ship 14, to the position shown in FIG. 5.

Figure 5:
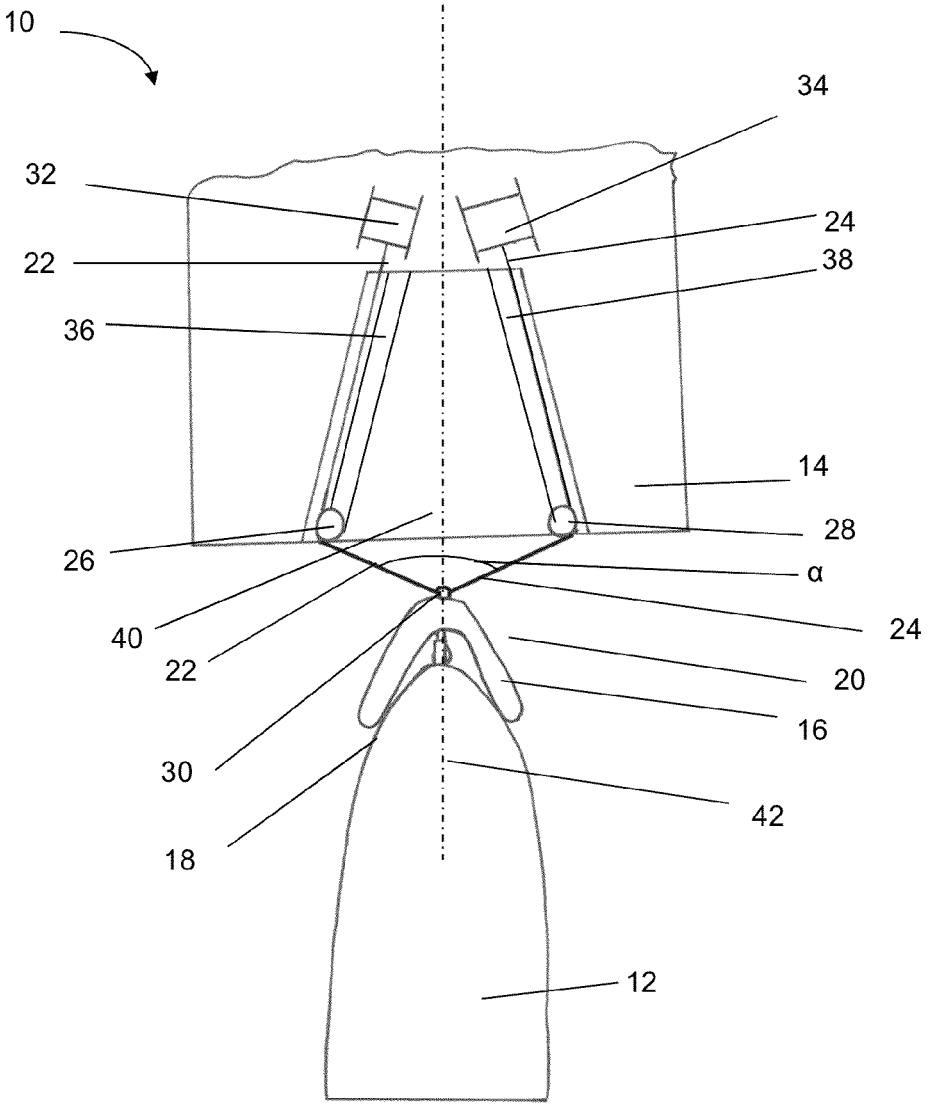
FIG. 5 is a schematic plan view of the marine craft recovery system shown in FIG. 1, with a connected arrangement of the marine craft and the hull dock in a partially recovered position.
Figure 6:
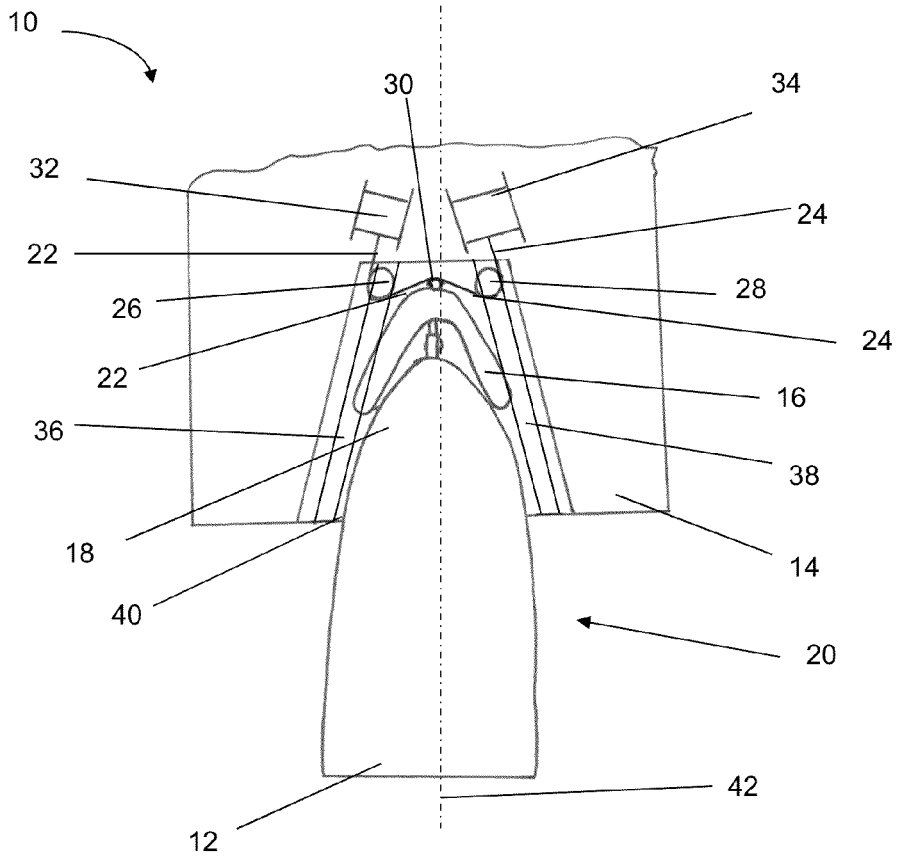
FIG. 6 is a schematic plan view of the marine craft recovery system shown in FIG. 1, with the connected arrangement of the marine craft and the hull dock in a fully recovered position.

As can be seen clearly in the position of FIG. 5, the angle $\alpha$ between the cables 22, 24 increases as the hull engager 16 nears the mother ship 14. As the angle $\alpha$ between the cables 22, 24 increases, the forward components of tension decrease relative to the lateral components. To assist in pulling the bow portion 18 into the stern well 40, the pulleys 26, 28 are driven forwards along the guide rails 36, 38. The respective winches 32, 34 are controlled to pull in the cables 22, 24 to maintain tension in the cables 22, 24 between the pulleys 26, 28 and the hull engager 16. The rollers on the underside of the hull engager 16 that cooperate with the central guide in the stern well 40 assist in a smooth transition of the hull engager 16 from the partially recovered position of FIG. 5 to the fully recovered position of FIG. 6. In the position shown in FIG. 6, personnel or equipment can be safely transferred between the marine craft 12 and the mother ship 14. The marine craft 12 can be supported on mounts by lessening the tension in the cables 22, 24 to lower the hull engager 16 and the marine craft 12 in the stern well 40.

Figure 7:
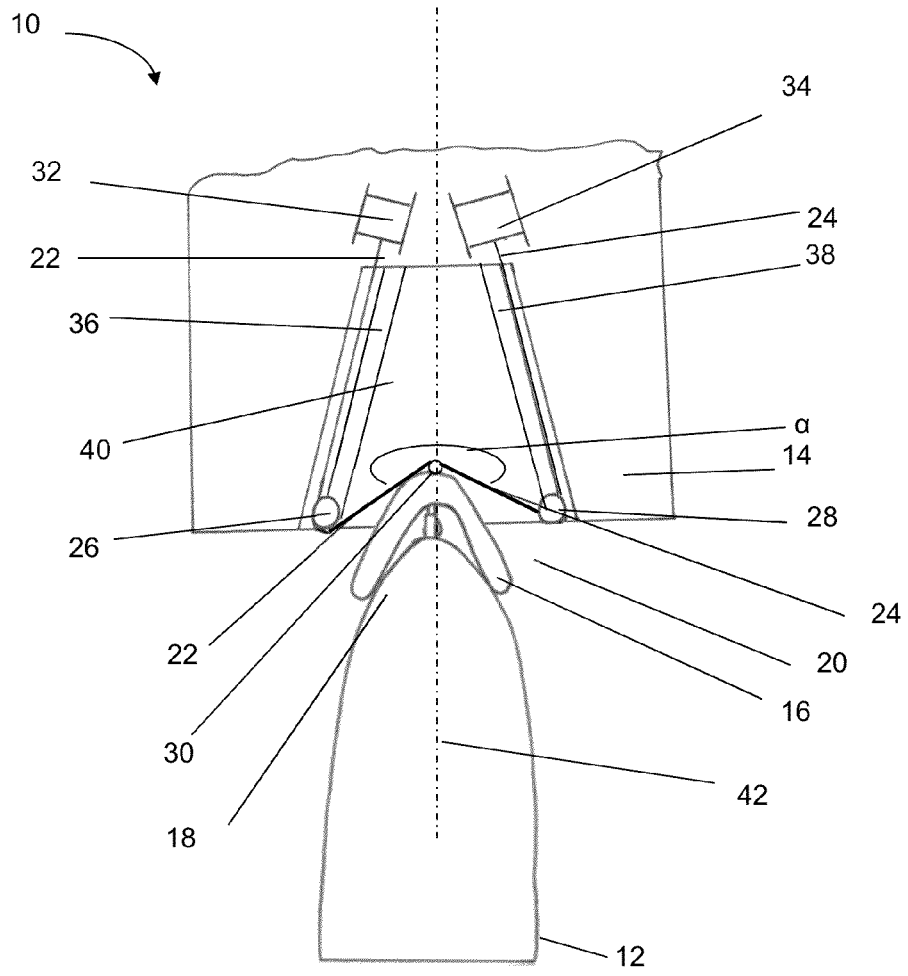
FIG. 7 is a schematic plan view of the marine craft recovery system shown in FIG. 1, with the connected arrangement of the marine craft and the hull dock in a partially deployed position.

It will be appreciated that the marine craft may be launched by substantially reversing the steps shown in FIGS. 3 to 6; in a process similar to the deployment of the hull engager 16 in FIGS. 1 to 3, with the addition of the marine craft 12 being present in the hull engager 16 from FIG. 1 onwards. Once deployed to the position of FIG. 4, the helmsman or remote operator of the marine craft 12 can adjust the marine craft 12 motor to use the motor to determine the marine craft's 12 position in the body of water 20 and control an actuator to disengage from the hull engager 16. To disengage, a disengagement switch is activated and forward thrust is applied. Thereafter, the hull engager 16 can optionally be recovered, reversing the processes shown between FIGS. 1 and 3. FIG. 7 illustrates that the hull engager 16 may be used to initially pull the marine craft 12 into the body of water 20. Gravity may assist in pulling the marine craft 12 into the water 20, such as the weight of the cables 22, 24 and/or the weight of the hull engager 16 and/or the marine craft 12. Activating the marine craft 12 motor can assist in steering the marine craft 12 away from the mother ship 14. Similarly, the mother ship 14 can alter course, such as by accelerating, to assist in deploying the marine craft 12 in the water 20.

Figure 8:
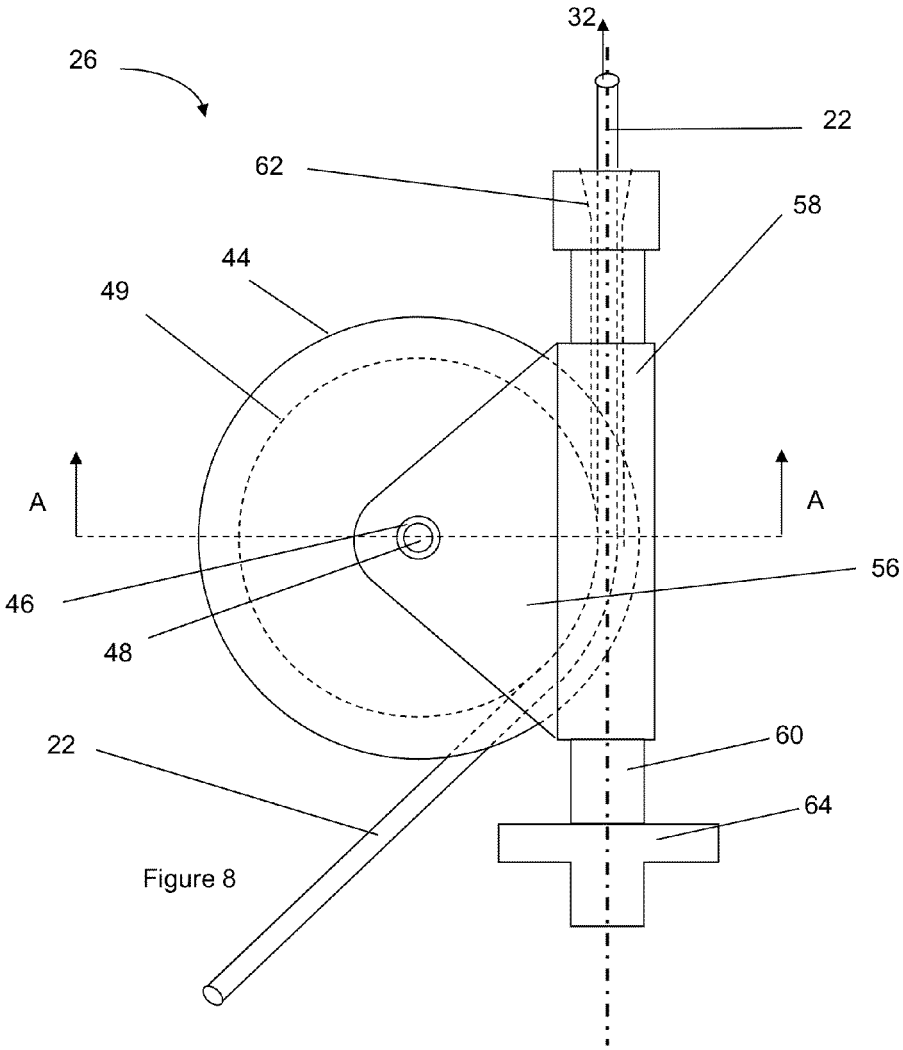
FIG. 8 shows part of an exemplary pulley of the marine craft recovery system of FIG. 1 in detail.
Figure 9:
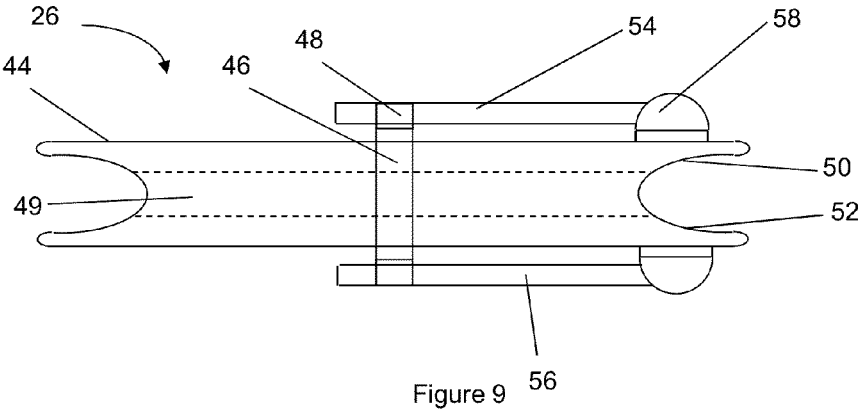
FIG. 9 shows a partial cross-section of the part of the exemplary pulley of FIG. 8 through A-A of FIG. 8.

FIGS. 8 and 9 show part of an exemplary pulley 26 in more detail. The pulley 26 comprises a sheave 44, rotatable about a central shaft 46 with a journal bearing 48. The cable 22 is partially wound around an internal track 49 in the sheave 44, with the fluted side walls 50, 52 of the sheave 44 preventing the cable 22 being laterally released from the sheave 44. The sheave 44 is sandwiched between two side plates 54, 56 connected to a sheave mounting bracket 58. The sheave mounting bracket 58 comprises radial bearings 60, 62 and a thrust bearing 64. The radial bearings 60, 62 are aligned with the axis of the cable 22 between the sheave 44 and the winch 32 to permit the sheave 44 to swivel without misalignment. The thrust bearing 64 accommodates an axial reaction force associated with the cable 22 running over the sheave 44.

Figure 10:
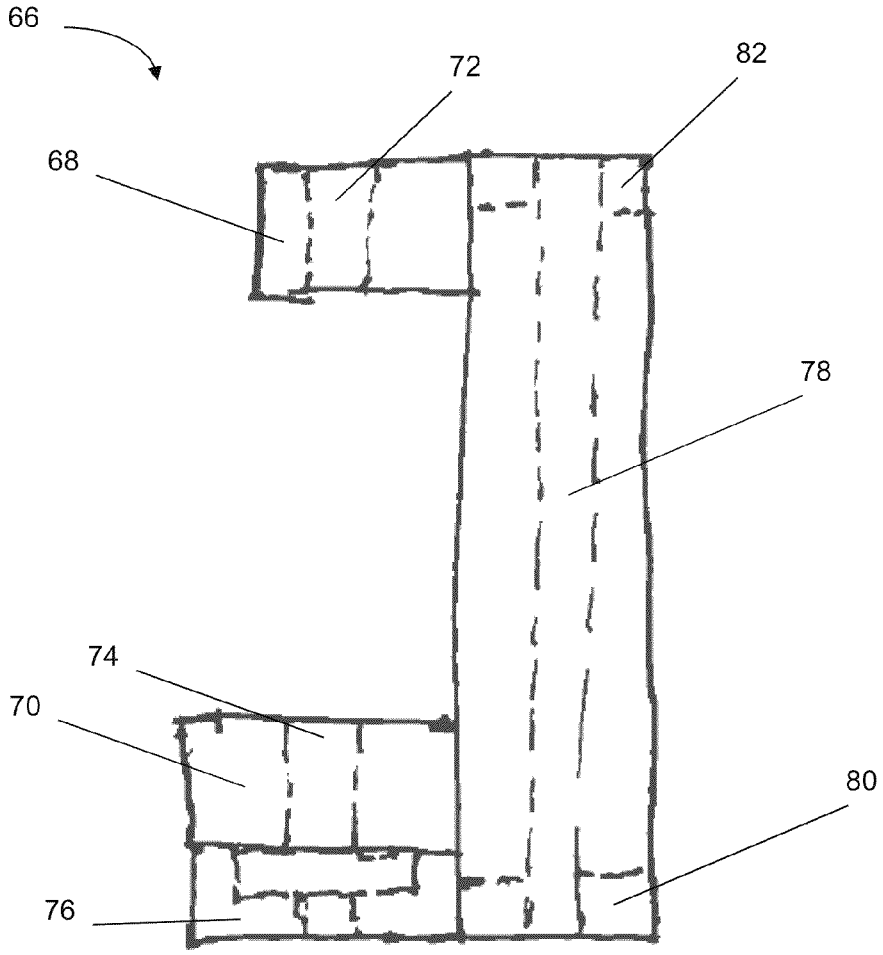
FIG. 10 shows a sliding block for housing exemplary pulley of FIG. 8.
Figure 11:
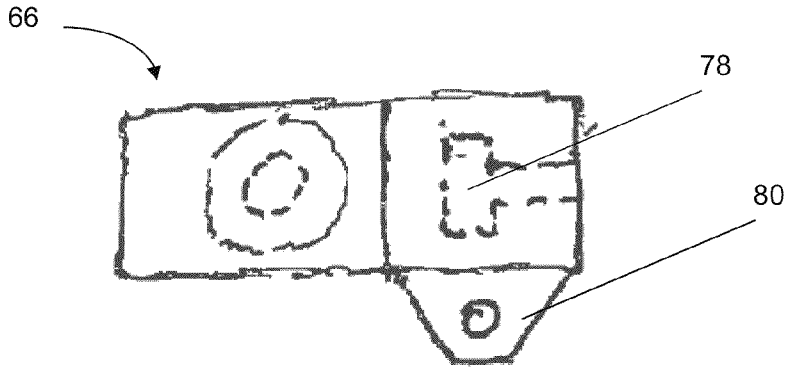
FIG. 11 shows an end view of the sliding block of FIG. 9.

FIGS. 10 and 11 show a sliding block 66 for housing the sheave mounting bracket 58 of FIG. 8. The sliding block has flanges 68, 70 with openings 72, 74 for receiving the radial bearings 60, 64; and an end plate 76 for receiving the thrust bearing 64. The sliding block 66 has a T-shaped axial profile 78 for sliding along the guide rail 36. At each end of the block 66 is located a drive attachment flange 80, 82 for attaching to respective ends of a drive chain (not shown).

As described above, a connector or engagement apparatus may be used to couple, for example automatically couple, the marine craft 12 to the hull engager 16 and some embodiments of the engagement apparatus will now be described in more detail with reference to FIGS. 12 onwards.

Figure 12:
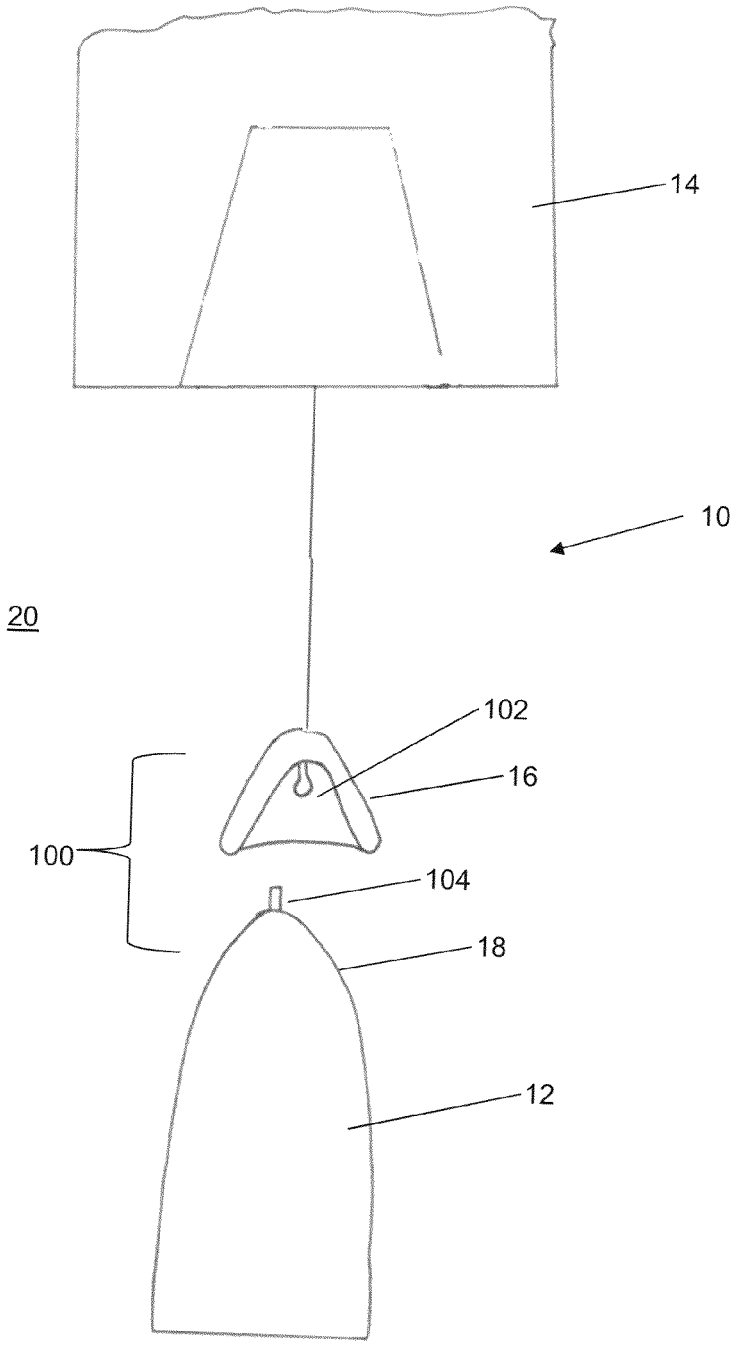
FIG. 12 shows a schematic plan view of the marine craft recovery system of FIG. 1 having an engagement apparatus according to an embodiment of the present invention.

Referring to FIG. 12 of the drawings, the system 10 has a hull engager 16 in the form of a buoyant device coupled to the mother ship 14 and configured to receive at least part of the marine craft 12. In FIG. 12, the hull engager 16 is shown coupled to the mother ship 14 via a single line or cable. However, it will be recognised that the system 10 may alternatively employ any of the arrangements described above and/or as shown in FIGS. 1 *to* 11. In use, the marine craft 12 engages the hull engager 16 to permit the marine craft 12 to be recovered across the body of water 20 to the mother ship 14. Similarly, where it is desired to deploy the marine craft 12 from the mother ship 14, the marine craft 12 may be disengaged from the hull engager 16.

The hull engager 16 comprises an engagement apparatus 100 in order to provide safe and secure engagement between the marine craft 12 and the mother ship 14, the engagement apparatus 100 having a receptacle 102 and an engagement probe 104. In the embodiment shown in FIG. 11, the receptacle 102 is provided on the hull engager 16 and the probe 104 is provided on the marine craft 12 to be recovered, although it will be recognised that the receptacle 102 may alternatively be provided on the craft 12 and the probe 104 provided on the hull engager 16 as appropriate.

Figure 13:
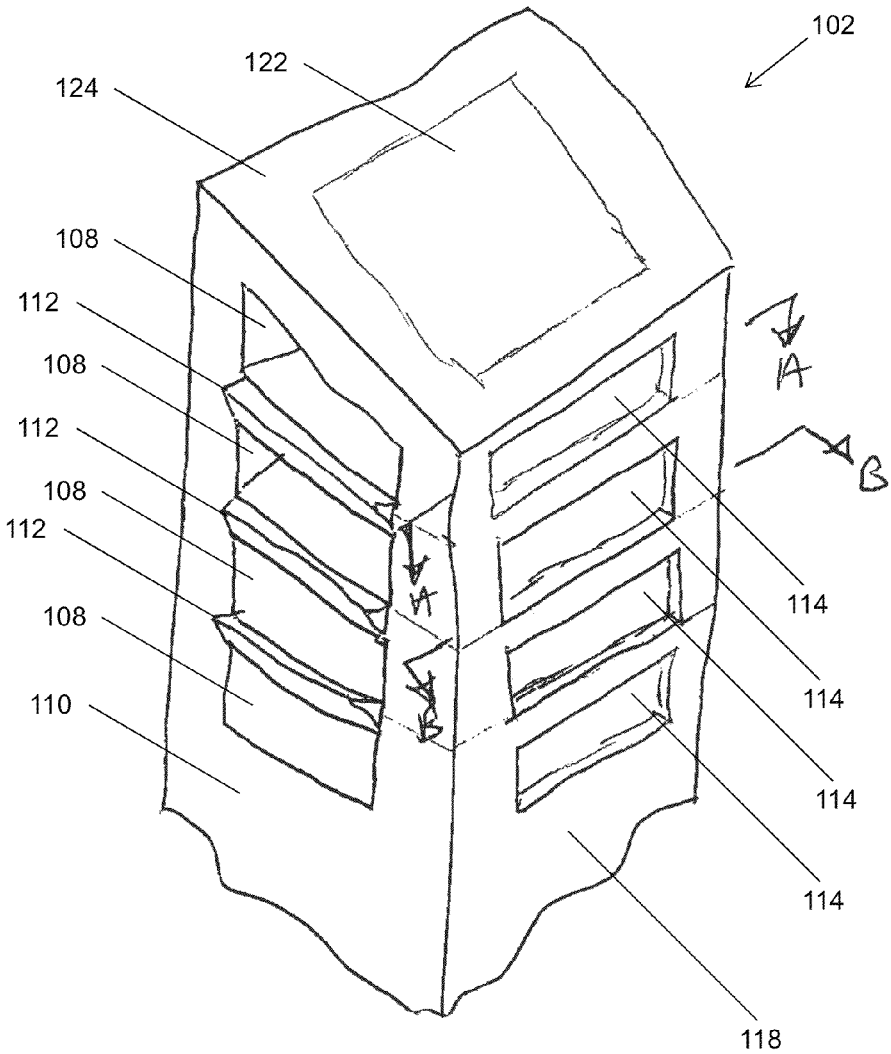
FIG. 13 shows a receptacle forming part of the engagement apparatus shown in FIG. 11.
Figure 14:
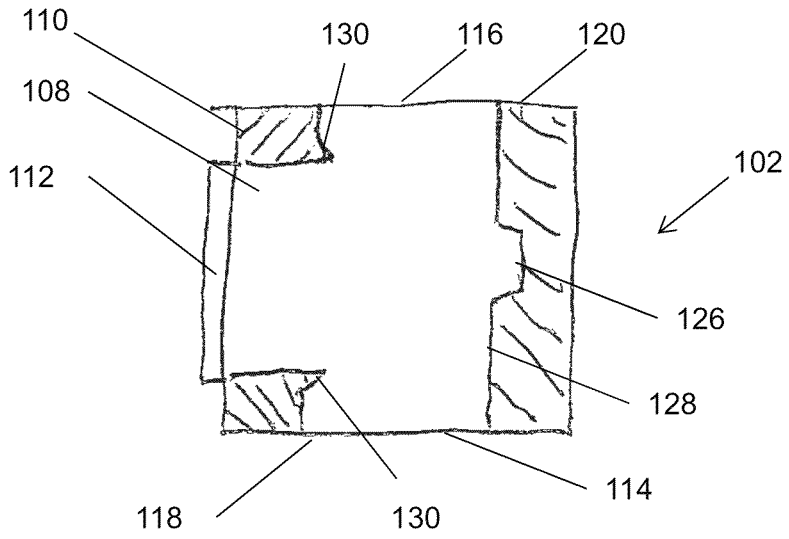
FIG. 14 shows a cross section view of the receptacle of FIG. 13, showing section A-A.
Figure 15:
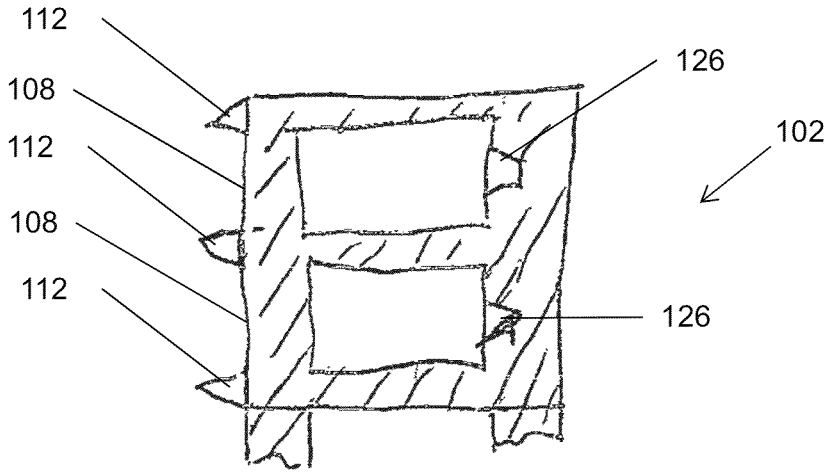
FIG. 15 shows a longitudinal section view of the receptacle of FIGS. 13 and 14, showing section B-B.

Referring to FIGS. 13 to 15 of the drawings, there is shown a receptacle 102 of the engagement system 100 according to an embodiment of the present invention. FIG. 13 shows a perspective view of the receptacle 102 and FIGS. 14 and 15 show cross section and longitudinal section views along A-A and B-B, respectively.

As shown in FIG. 13, the receptacle 102 comprises a generally square or rectangular section beam 106 having a number of vertically arranged openings in the form of holes or slots 108 (four slots 108 are shown in FIG. 13). The slots 108 are provided in a front surface 110 of the receptacle 102 and, in use, define engagement locations for receiving the probe 104. The slots 108 are machined, although any other suitable manufacturing technique may be used where appropriate. The provision of multiple slots 108 permits engagement between the probe 104 and the receptacle 102 to be achieved even when there is significant relative motion between the probe 104 and the receptacle 102. The slots 108 are of a size and shape to receive and permit activation of the probe 104 to secure the probe 104 to the receptacle 102, as will be described below.

Ramps 112 are provided between a number of the slots 108 and, in use, the ramps 112 provide a tapered entrance to the slots 108.

The receptacle 102 further comprises a number of slots 114, 116 provided in side surfaces 118,120 of the receptacle 102. The slots 114,116 may provide space for a locking device, may allow water to escape and/or provide access for repair. A generally square hole 122 is also provided in a top surface 124 of the receptacle 102.

A generally square hole 122 is also provided in a top surface 124 of the receptacle 102.

As shown in FIGS. 14 and 15, a number of notches or recesses 126 are also provided in an inside back surface 128 of the receptacle 102, and in the embodiment shown each slot 108 comprises a corresponding recess 126.

The receptacle 102 further comprises angled shoulders 130 and, in use, the probe 104 is adapted to engage the shoulders 130 to secure the probe 104 to the receptacle 102.

Figure 16:
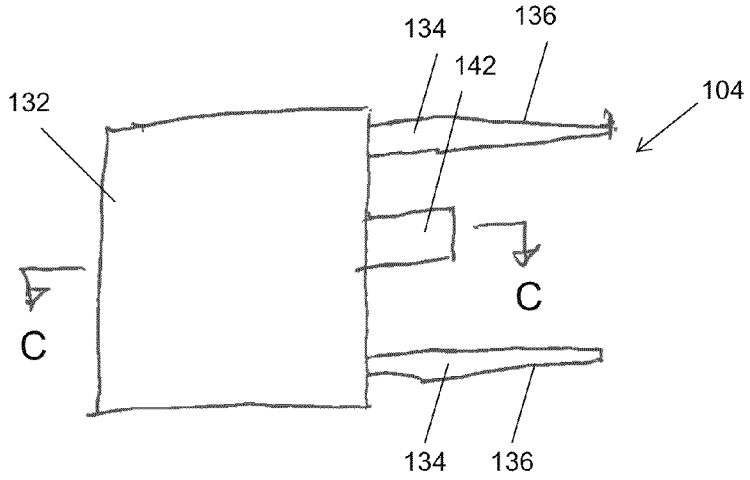
FIG. 16 shows a side view of a probe forming part of the engagement apparatus shown in FIGS. 13 to 15.
Figure 17:
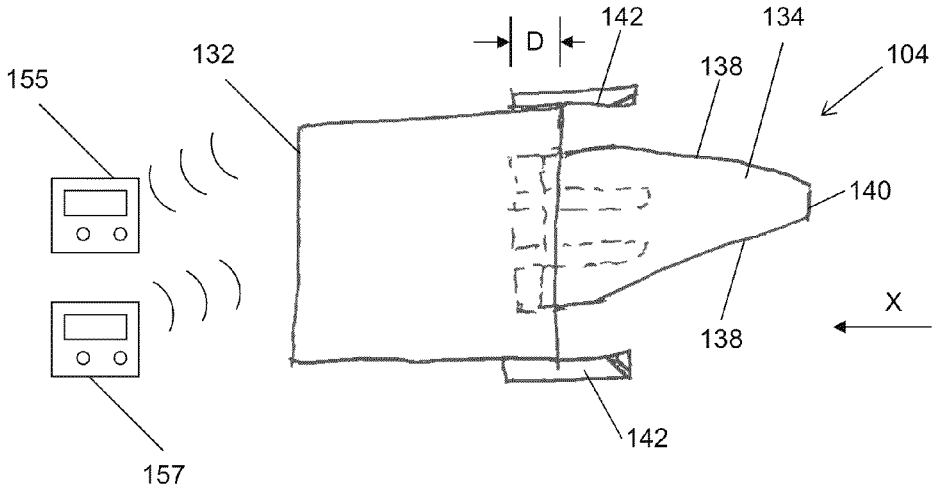
FIG. 17 shows a longitudinal section view of the probe of FIG. 16, showing section C-C.

A probe 104 according to an embodiment of the present invention is shown in FIGS. 16 and 17, the probe 104 for use with the receptacle 102 shown in FIGS. 13 to 15.

FIG. 16 shows a side view of the probe 104 and FIG. 17 shows a longitudinal section view of the probe 104, showing section C-C of FIG. 16.

The probe 104 has a housing 132 and two probe first portions in the form of daggers 134. As shown in FIG. 16, the top surfaces 136 of the daggers 134 are tapered. As shown in FIG. 17, the side surfaces 138 of the daggers 136 are also tapered. In the embodiment shown, the daggers 134 are about 203.2 mm (8 inches) in length and about 152.4 mm (6 inches) at their widest point, although the daggers 134 may be of any suitable dimensions to permit engagement with the receptacle 102.

In use, when the marine craft 12 is directed towards the receptacle 102, the daggers 134, which form the leading end of the probe 104, engage with a given slot 108 and the distal-most end 140 of each dagger 134 engages with the respective recess 126 in the receptacle 102. When fully engaged with the recess 126, the daggers 134 conform to the recess so that there is no slop.

Figure 18:
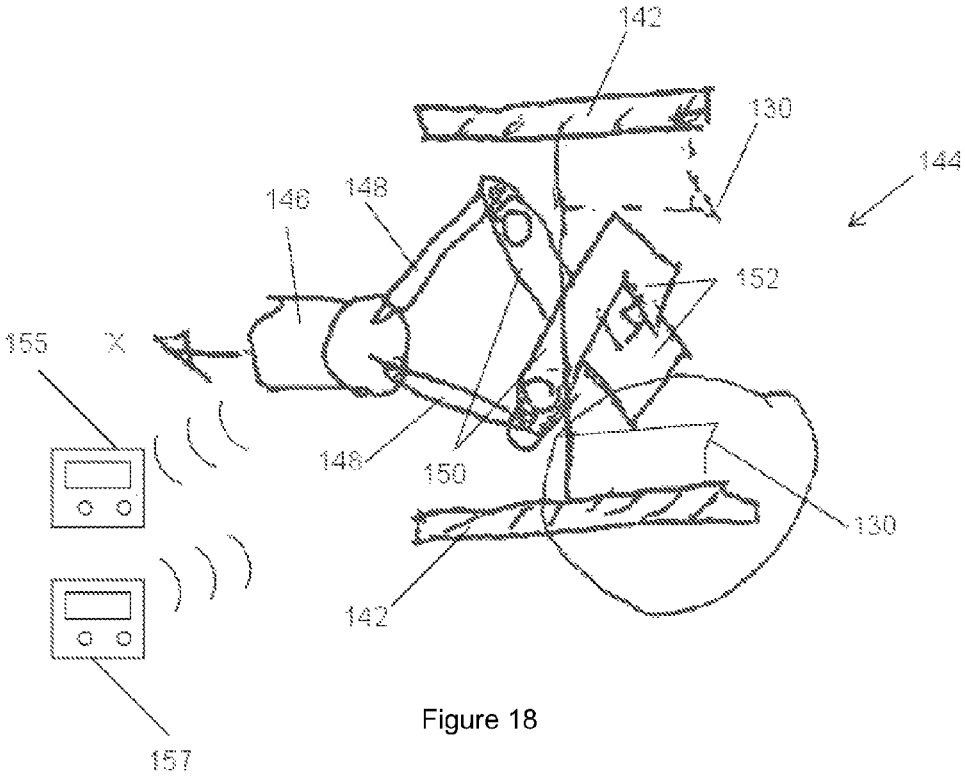
FIG. 18 shows a cross section view of part of the engagement apparatus shown in FIGS. 13 to 17, wherein the probe is engaged with the receptacle and showing a locking device prior to activation.

Wings 142 are also provided on the outer surfaces of housing 132 and, in use, the wings 142 engage the outer surfaces of the receptacle 104 (as shown most clearly in FIG. 18).

The daggers 134 are spring loaded so that at full engagement, that is when the distal most end 140 of the daggers 134 engage the recess 108, the dagger 134 will be depressed axially by a distance "D" in the direction shown by arrow "X" in FIG. 16, this movement triggering activation of a locking device 144, as will be described in more detail below. In the embodiment shown, the daggers 134 are configured to move a distance of about 12.7 mm (0.5 inch) to activate the locking device 144.

Figure 19:
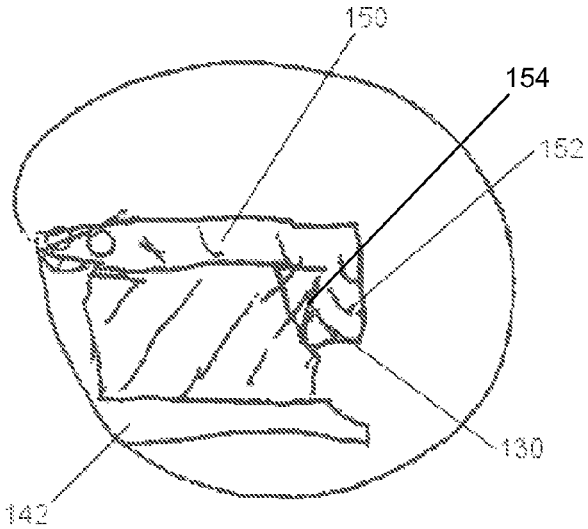
FIG. 19 shows an enlarged view of part of the locking device shown in FIG. 18, following activation/engagement with the receptacle.

Referring now to FIGS. 18 and 19 of the drawings, there is shown a locking device 144 according to an embodiment of the present invention for use in the engagement apparatus 100. The locking device 144 comprises an actuation arm 146 operatively coupled to the or each dagger 134. In use, axial depression of the dagger 134 in direction X following engagement with the recess 126 results in corresponding axial displacement of the arm 146. Articulated connection members 148, 150 are coupled to the arm 146, and in use axial displacement of the arm 146 causes the connection members 150 to pivot outwards in opposing directions to engage the receptacle 104, as shown in FIG. 18. The connection members 150 take the form of hook arms, the hook portion 152 arranged to engage the shoulders 130 in the receptacle 104. The hook portions 152 may further be provided with tapered surfaces 154 to further assist in securing the probe 104 to the receptacle 102.

In the embodiment shown, the locking device 144 is positioned so as to engage the slot 108 above the one engaged by the daggers 134, although it will be recognised that the locking device 144 may alternatively engage the same slot 108 as the daggers 134.

An indicator arrangement 155 is also provided to indicate the status of the apparatus to a user, for example to the helmsman or remote operator of the marine craft 12, to a crew member on the mother ship 14 or to another remote location. In the embodiment shown, the indicator arrangement 155 is configured to receive radio frequency signals from the apparatus 100 to indicate alignment between the probe 104 and the receptacle 102; full engagement between the dagger 134 and a recess 126 so that activation of the locking device may be initiated; and disengagement between the probe 104 and the receptacle 102.

The apparatus 100 further comprises a control system 157 configured to initiate engagement and disengagement between the probe 104 and the receptacle 102. In some embodiments, the control system 157 may be configured to automatically initiate activation or deactivation of the locking device 144. In other embodiments, the control system 157 may used in combination with the indicator arrangement 155 and a user, whereby on receiving an appropriate signal from the indicator arrangement 155, the user is directed to operate the control system 157 to activate or deactivate the locking device 144.

In use, the marine craft 12 is directed towards the hull engaging apparatus so that the probe 104 engages the receptacle 102. The daggers 134 of the probe 104 engage with a slot 108 of the receptacle 102 to align the probe 104 with the receptacle 102. At this stage, a first LED of the indicator arrangement 155 may be illuminated to indicate to the helmsman or remote operator of the marine craft 12 that the probe 104 and receptacle are aligned. On achieving full engagement between the daggers 134 and the recess 126, a second LED of the indicator arrangement may be illuminated to indicate to the helmsman or remote operator that the locking device 144 should be engaged, or in embodiments where the locking device 144 is automatically engaged, that the locking device 144 is engaged.

When recovering the marine craft, the second LED will signal to the helmsman or remote operator to initiate reverse thrust, this securing or further securing the probe 104 to the receptacle 102 to facilitate transport of the marine craft 12 to the mother ship 14. During deployment, the helmsman or remote operator will also maintain reverse thrust and the engaged light will be lit. To disengage, the helmsman or remote operator pushes a disengage switch or button, and should switch to forward thrust.

Figure 20:
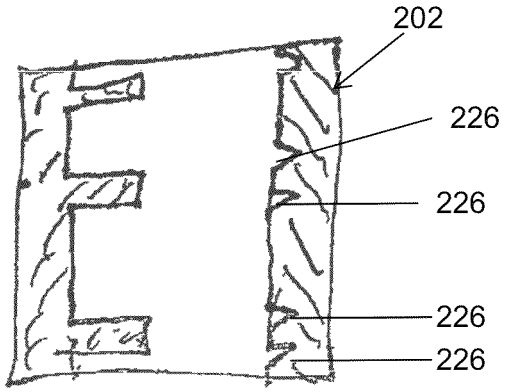
FIG. 20 shows a longitudinal section view of a receptacle according to an alternative embodiment of the present invention.
Figure 21:
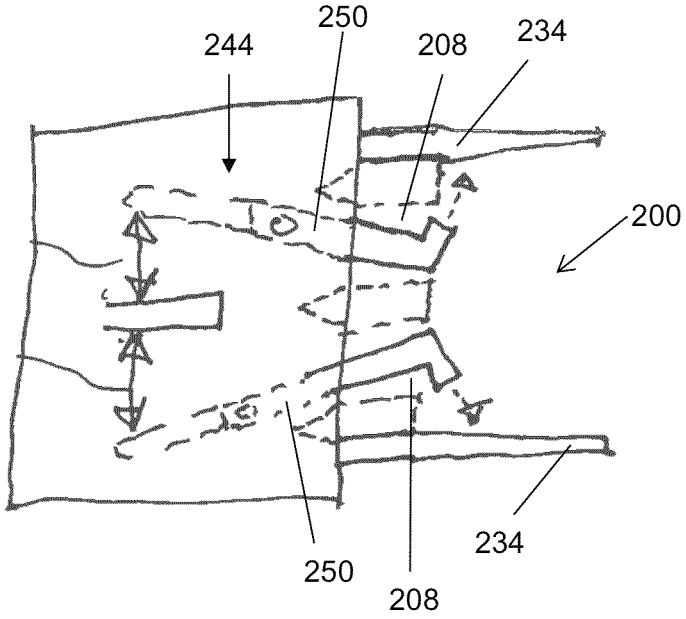
FIG. 21 shows a longitudinal section view of part of the engagement apparatus of the embodiment shown in FIG. 20 and showing an alternative locking device prior to activation.

Referring now to FIGS. 20 and 21 of the drawings, there is shown an alternative apparatus 200 according to an alternative embodiment of the present invention. The apparatus 200 is similar to the apparatus 100 shown in FIGS. 12 to 19 and corresponding features are represented by corresponding numerals incremented by 100.

FIG. 20 shows a longitudinal section view of a receptacle 202 according to the alternative embodiment of the present invention. The receptacle 202 is outwardly identical to the receptacle 102 shown in FIG. 13. The receptacle 202 differs in its internal geometry from the receptacle 102 by having two recesses 226 provided in each slot 208, the recesses 226 provided at axially spaced locations so as to receive daggers 234 of probe 204.

FIG. 21 shows a longitudinal section view of part of the apparatus 200, wherein the probe 204 is positioned within the receptacle 202 and prior to engagement of locking device 244. In this alternative embodiment, hook arms 250 are configured to pivot vertically to engage shoulders 230 in the receptacle 202 and secure the probe 204 to the receptacle 202.

The apparatus 200 also comprise an indicator arrangement 255, the indicator arrangement corresponding to the arrangement 155 described in relation to the first embodiment of the invention.

Referring now to FIGS. 22 to 26, there is shown an apparatus 300 according to a further alternative embodiment of the invention. Like components between the apparatus 100 or 200 and apparatus 300 are shown by like numerals.

FIG. 22 shows a side view of a probe 304 according to this embodiment. FIG. 23 shows an enlarged view of part of the probe 304 shown in FIG. 22. FIG. 24 shows a top view of the probe 304. As shown, a rear portion of the probe 304 comprises a mounting block or housing 332 having a recess 342 shaped to conform to a hull, in particular a bow, of a marine craft. A front portion of the wall of the recess 342 is sloped (shown in hidden line in FIG. 22). An anchor attachment point extends from the mounting block and permits the probe 304 to be secured to the marine craft. Almost all marine crafts have an anchor attachment eye on their bow, the attachment eye being capable of withstanding considerable loading. Beneficially, the attachment eye can be removed and replaced by the probe 304 with little alteration to the bow.

A front portion of the probe 304 comprises a dagger 334 having a distal leading end 340, a tapered upper surface 336 and tapered side surfaces 338. The lower surface 359 may also be tapered. A latching recess 361 is provided on the dagger 334 between the tapered upper surface 336 and the housing 332, the latching recess 361 defining a latching surface 363.

Figure 25:
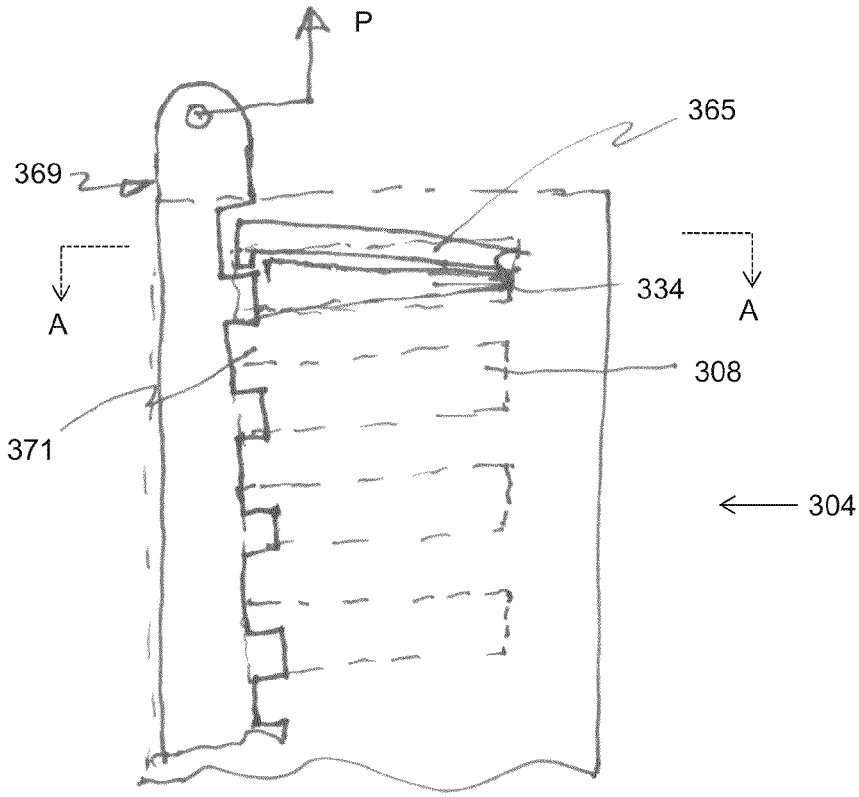
FIG. 25 shows a longitudinal section view of a receptacle for receiving the probe of FIGS. 22 to 24.
Figure 26:
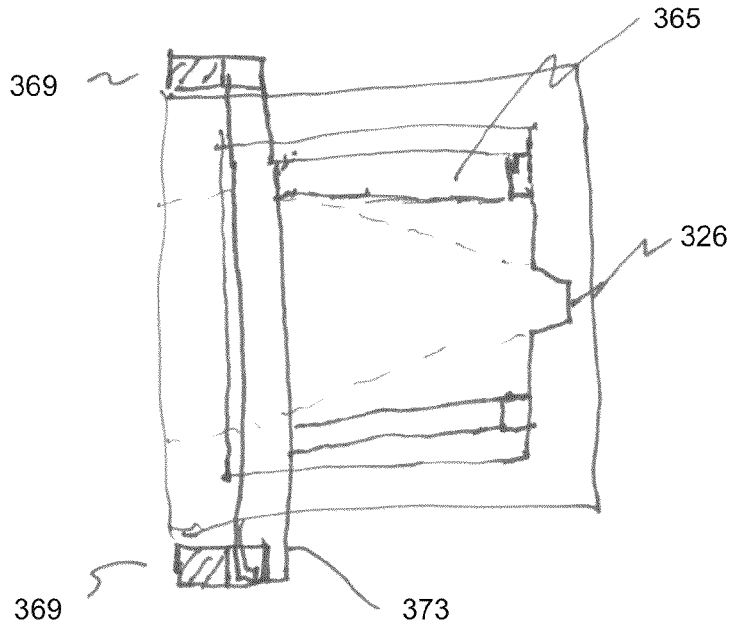
FIG. 26 shows a cross sectional view of section A-A of FIG. 25.

Reference is now made also to FIGS. 25 and 26 which show an alternative receptacle 302. FIG. 25 shows a longitudinal section through the receptacle 302. FIG. 26 shows a cross sectional view of section A-A of FIG. 25. As shown, the receptacle 302 comprises latching brackets 365 in each slot 308, the latching brackets 365 being mounted to the receptacle 302 via hinges 367.

Two latching bars 369 are mounted to each side of the receptacle 302 in a manner which permits the latching bars 369 to be capable of sliding up and down. The latching bars 369 are mechanically connected at the top to permit an actuator, such as the actuator described above, to pull up the latching bars 369 (in the direction P) to an unlatched position whereby the bracket is located in a slot 371. In use, movement of the latching bars 369 to the unlatched position will pivot the latching brackets 365 to the unlatched position.

As shown in FIG. 26, the latching brackets 365 comprise extensions 373 which engage with the latching bars 369. Also, recesses 326 are provided in the wall of the receptacle 302 and are each fitted with electrical switches to indicate the engagement state of the apparatus 300.

When the hull engager is deployed for engagement, the latching bars 367 are lifted partially up, but are still below a disengaged position. This will allow increased clearance between the latching bracket 365 and the dagger 334 as it enters. As the dagger 334 approaches full engagement, contact between the dagger 334 and the latching bracket 365 will be made and the latching bracket 365 will be rotated upwards. When full engagement is made, the latching bracket 365 will fall partially into the latching recess 361 (FIGS. 22 and 23). Upon the controller receiving a fully engaged signal, the latching bars 367 will lower, thus allowing full mating of the latching bracket 365 with the dagger 334.

It should be understood that the embodiments described herein are merely exemplary and that various modifications may be made thereto without departing from the scope of the invention.

For example, in the embodiments shown, the marine craft is a RIB. However, the skilled person will appreciate the system may be for other marine crafts, such as a submersible craft; and/or a semi-submersible craft.

Similarly, where the marine craft shown here is manned, the skilled person will appreciate that the marine craft may be unmanned, such as an autonomous or remotely-controlled craft. It will be understood that references to a helmsman or user on the marine craft should, when the marine craft to be recovered is unmanned, be taken to mean a remote operator.

Although shown in the embodiments here as a powered boat, the boat may comprise an unpowered boat, such as a sailboat. Similarly, where the mother ship shown here is a larger boat, the mother ship may be another marine structure, such as a submarine or a platform, such as a floating platform, or other location to which the marine craft is to be secured, recovered and/or deployed.

In some embodiments, the marine craft engagement apparatus on which at least part of the engagement apparatus may be mounted or coupled may comprise a hull dock configured to receive at least a portion of a hull of the marine craft, such as a bow section. In use, the hull dock may be deployed and retrieved from the mother ship and the engagement apparatus operated to engage and secure the marine craft to the hull dock and thus the mother ship for recovery or deployment. Although the hull engager shown here is a bow dock for engaging a bow portion of the marine craft, the marine craft engagement apparatus may be configured to engage a different portion of a marine craft, such as comprising a stern dock for engaging a stern portion of a marine craft. In further alternative embodiments, the hull engager may be directly coupled to the mother ship hull.

As described above, the engagement apparatus may resist or prevent disengagement between the marine craft to be recovered and the hull engager during launch and/or recovery, for example by providing the angled shoulders to which the probe is adapted to be engaged to secure the probe to the receptacle. In use, it is envisaged that the connection between the hull engager or probe and the receptacle should be slack. This may be achieved by the helmsman or remote operator of the marine craft positioning the craft relative to the mother ship so as to have slack cables, for example before and/or after the actuator is activated.

The apparatus and methods of the present invention may also be used in combination with the engagement apparatus and associated method of applicant's U.S. Ser. No. 13/042,118, which is incorporated herein in its entirety by way of reference.

The invention claimed is:

1. A marine craft recovery system for recovering a marine craft to a mother ship, the system comprising:

a marine craft engagement apparatus for coupling to at least a portion of the marine craft;

at least a first tensile member and a second tensile member, the first and second tensile members configured to extend between the marine craft engagement apparatus and the mother ship, wherein the first tensile member is configured to pull the marine craft engagement apparatus in a first direction towards a first anchor point and the second tensile member is configured to pull the marine craft engagement apparatus in a second, different, direction towards a second anchor point;

a first pulling mechanism configured to pull the first tensile member towards a first anchor point on the mother ship; and a second pulling mechanism configured to pull the second tensile member towards a second anchor point on the mother ship, wherein the system is configured to transport the marine craft engagement apparatus across a body of water towards the mother ship and to pull the marine craft engagement apparatus in a third direction substantially away from the mother ship.

2. The marine craft recovery system of claim 1, wherein the first and second tensile members are configured to pull the marine craft engagement apparatus in divergent directions towards the mother ship.

3. The marine craft recovery system of claim 1, wherein the system is configured to deploy the marine craft from the mother ship.

4. The marine craft recovery system of claim 1, wherein the system comprises a propulsion unit configured to pull the marine craft engagement apparatus in the third direction.

5. The marine craft recovery system of claim 4, wherein the marine craft engagement apparatus comprises the propulsion unit.

6. The marine craft engagement apparatus of claim 4, wherein the system is configured to locate a neutral position of the marine craft engagement apparatus relative to the mother ship.

7. The marine craft recovery system of claim 3, wherein the marine craft engagement apparatus is configured to engage a same portion of the marine craft during deployment and recovery.

8. The marine craft recovery system of claim 3, wherein the marine craft engagement apparatus is configured to engage different portions of the marine craft during deployment and recovery.

9. The marine craft recovery system of claim 1, wherein the first and second anchor points are in substantially the same horizontal plane.

10. The marine craft recovery system of claim 1, wherein the first and second anchor points are mounted to a first and a second anchor transport system respectively, the first and second anchor transport systems configured to move the respective first and second anchor points with respect to the mother ship.

11. The marine craft recovery system of claim 10, wherein the first anchor transport system is operatively linked to the second anchor transport system.

12. The marine craft recovery system of claim 10, wherein the first anchor transport system is operatively independent from the second anchor transport system.

13. The marine craft recovery system of claim 10, wherein the first and second anchor transport systems are configured to position the respective first and second anchor points in aft positions when the marine craft engagement apparatus is in a remote position from the mother ship, and the first and second anchor transport systems are configured to move the respective first and second anchor points to fore positions when pulling the marine craft engagement apparatus proximal to the mother ship.

14. The marine craft recovery system of claim 10, wherein the marine craft recovery system is configured to pull the marine craft engagement apparatus at least partially into the mother ship with at least the first anchor transport system.

15. The marine craft recovery system of claim 1, wherein the marine craft engagement apparatus is configured to secure the marine craft to the marine craft engagement apparatus.

16. The marine craft recovery system of claim 1, wherein the marine craft engagement apparatus comprises a connector configured to release the marine craft.

17. The marine craft recovery system of claim 1, wherein the system comprises a plurality of marine craft engagement apparatus.

18. A method of recovering a marine craft to a mother ship, the method comprising:

deploying a marine craft engagement apparatus from the mother ship;

controlling a position of the marine craft engagement apparatus in a body of water astern the mother ship with at least a first tensile member and a second tensile member, the first tensile member configured to pull the marine craft engagement apparatus in a first direction towards a first anchor point and the second tensile member configured to pull the marine craft engagement apparatus in a second, different, direction towards a second anchor point, and by pulling the marine craft engagement apparatus in a third direction which is substantially away from the mother ship;

manoeuvring the marine craft relative to the marine craft engagement apparatus such that at least a portion of the marine craft engages the marine craft engagement apparatus;

connecting the marine craft to the marine craft engagement apparatus;

controlling a movement of the marine craft engagement apparatus across a body of water towards the mother ship with the first and second tensile members.

19. The method of claim 18, wherein the marine craft engagement apparatus comprises the propulsion unit.

20. The method of claim 18, comprising locating a neutral position of the marine craft engagement apparatus relative to the mother ship.

* * * * *